US012096899B2

(12) United States Patent
Huang

(10) Patent No.: US 12,096,899 B2
(45) **Date of Patent: *Sep. 24, 2024**

(54) MOP BUCKET FOR CLEANING AND SQUEEZING A FLAT MOP

(71) Applicant: CIXI BOSHENG PLASTIC CO., LTD., Zhejiang (CN)

(72) Inventor: Zhiyong Huang, Cixi (CN)

(73) Assignee: CIXI BOSHENG PLASTIC CO., LTD., Cixi (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/364,642

(22) Filed: Aug. 3, 2023

(65) Prior Publication Data

US 2023/0371776 A1 Nov. 23, 2023

Related U.S. Application Data

(63) Continuation of application No. 16/933,695, filed on Jul. 20, 2020, now Pat. No. 11,744,434, which is a (Continued)

(30) Foreign Application Priority Data

Jun. 4, 2016 (CN) ..... 201620530924.7
Aug. 9, 2016 (CN) ..... 201620853180.2
(Continued)

(51) Int. Cl.
*A47L 13/59* (2006.01)
*A47L 13/256* (2006.01)
*A47L 13/60* (2006.01)

(52) U.S. Cl.
CPC ..... *A47L 13/59* (2013.01); *A47L 13/256* (2013.01); *A47L 13/60* (2013.01)

(58) Field of Classification Search
CPC ..... A47L 13/59; A47L 13/256; A47L 13/60
See application file for complete search history.

(56) References Cited

U.S. PATENT DOCUMENTS 2,796,617 A 6/1957 Bradshaw
4,798,307 A 1/1989 Evrard
(Continued)

FOREIGN PATENT DOCUMENTS

CN 201171658 Y 12/2008
CN 201453170 U 5/2010
(Continued)

OTHER PUBLICATIONS

International Search Report issued on Aug. 11, 2017, in corresponding International Application No. PCT/CN2017/000347; 8 pages.

*Primary Examiner* — Shay Karls
(74) *Attorney, Agent, or Firm* — Maier & Maier, PLLC

(57) ABSTRACT

A mop bucket for cleaning and squeezing a flat mop, includes a bucket body and a squeezing device disposed inside the bucket body; the bucket body has a squeezing water section and a cleaning section, which are respectively at two different positions when used; when the mop head of the flat mop is removably inserted into the squeezing device, the squeezing device presses against the wiper on the mop head and scrapes the wiper on the mop head. The embodiments also include a cleaning tool set. The mop bucket can clean and squeeze a wiper on the flat mop by integrating both functions of cleaning and squeezing together, provide better cleaning and squeezing effects, and realize a convenient and labor-saving squeezing operation and pleasurable user experience.

18 Claims, 35 Drawing Sheets

Related U.S. Application Data continuation of application No. 15/743,920, filed as application No. PCT/CN2017/000347 on May 11, 2017, now Pat. No. 10,722,094.

(30) Foreign Application Priority Data

| | | |
|---|---|---|
| Apr. 30, 2017 | (CN) | 201720468440.9 |
| Apr. 30, 2017 | (CN) | 201720468446.6 |
| Apr. 30, 2017 | (CN) | 201720468451.7 |
| Apr. 30, 2017 | (CN) | 201720468452.1 |

(56) References Cited

U.S. PATENT DOCUMENTS

| | | | |
|---|---|---|---|
| 6,115,878 | A | 9/2000 | McLaughlin et al. |
| 6,279,195 | B1 | 8/2001 | Biggs |
| 2007/0240270 | A1 | 10/2007 | Urbano et al. |
| 2013/0139848 | A1 | 6/2013 | Goentzel |

FOREIGN PATENT DOCUMENTS

| | | | |
|---|---|---|---|
| CN | 201675888 | U | 12/2010 |
| CN | 101987007 | A | 3/2011 |
| CN | 203074606 | U | 7/2013 |
| CN | 203861163 | U | 10/2014 |
| CN | 204146973 | U | 2/2015 |
| CN | 204146974 | U | 2/2015 |
| CN | 204765490 | U | 11/2015 |
| CN | 105496330 | A | 4/2016 |
| CN | 205391076 | U | 7/2016 |
| CN | 205493747 | U | 8/2016 |
| CN | 205729276 | U | 11/2016 |
| CN | 206080446 | U | 4/2017 |
| CN | 106983465 | A | 7/2017 |
| EP | 2769661 | A2 | 8/2014 |
| EP | 3446613 | A1 | 2/2019 |
| JP | S5549732 | Y2 | 11/1980 |
| JP | S6016357 | Y2 | 5/1985 |
| JP | S6323633 | A | 1/1988 |
| JP | S6364370 | U | 4/1988 |
| JP | H0333320 | Y2 | 7/1991 |
| JP | 2004230052 | A | 8/2004 |
| WO | 9710742 | A1 | 3/1997 |
| WO | 2015085016 | A1 | 6/2015 |

MOP BUCKET FOR CLEANING AND SQUEEZING A FLAT MOP

CROSS-REFERENCE TO RELATED APPLICATIONS

This application is a continuation of U.S. patent application Ser. No. 16/933,695, filed Jul. 20, 2020, which is a continuation of U.S. patent application Ser. No. 15/743,920, filed Jan. 11, 2018, now U.S. Pat. No. 10,722,094, issued Jul. 28, 2020, which is a national stage entry under 35 U.S.C. 371 of PCT Patent Application No. PCT/CN2017/000347, filed May 11, 2017, which claims priorities to Chinese Patent Application No. 201620530924.7, filed Jun. 4, 2016; Chinese Patent Application No. 201620853180.2, filed Aug. 9, 2016; Chinese Patent Application No. 201720468446.6, filed Apr. 30, 2017; Chinese Patent Application No. 201720468451.7, filed Apr. 30, 2017, Chinese Patent Application No. 201720468452.1, filed Apr. 30, 2017; and Chinese Patent Application No. 201720468440.9, filed Apr. 30, 2017, the entire contents of each of which are incorporated herein by reference.

BACKGROUND

In the prior art, there are three approaches for squeezing a flat mop. The first approach is by stepping on the pedal to squeeze a mop fabric on the flat mop. In this approach, a foot-operated squeezing device is provided on a mop bucket; the foot-operated squeezing device comprises a squeezing basket built-in the mop bucket and a pedal hinged to an upper portion of the mop bucket and arranged in opposite to the squeezing basket; and, the pedal and the squeezing basket form a squeezing space. During squeezing, the mop fabric on a mop plate of the flat mop should be detached firstly, the mop fabric is then placed into the squeezing space, and the squeezing space is shrunk by stepping on the pedal so as to squeeze water from the mop fabric. In this squeezing approach, a foot-operated squeezing device with a complicated structure needs to be designed, and the cost is thus relatively high; moreover, during squeezing, the mop fabric needs to be detached, and a pedaling operation needs to be performed by a foot, so that the operation is inconvenient.

The second approach is by centrifugal rotation. In this approach, a hand-operated rotary mop rod is used. During squeezing, two ends of a mop plate of a flat mop need to be bent and then placed into a squeezing water section in a mop bucket and then the mop rod is pressed down, so that the mop plate of the flat mop is centrifugally rotated for squeezing. In this squeezing approach, the mop plate of the flat mop needs to be designed as a bendable structure, the structure is complicated, and such a squeezing approach requires a hand-operated rotary mop rod so that the cost is relatively high.

The third approach is by pushing manually and squeezing. For example, Chinese Utility Model Patents CN201171658Y (Patent No.: ZL200720192814.5), CN203074606U (Patent No.: ZL201320019718.6), CN204146974U (Patent No.: ZL201420624020.1) and the like, disclosed a kind of flat mop, which comprises a mop rod, a flat mop plate movably connected onto the mop rod, a wiper disposed on the flat mop plate, and a squeezing mechanism disposed on the mop rod. The wiper on the flat mop plate is squeezed and cleaned by the relative movement and squeezing between the squeezing mechanism and the flat mop plate. This approach has the following disadvantages: during squeezing, it is necessary to hold the mop rod by one hand and the squeezing mechanism by the other hand to achieve the relative movement and squeezing between the squeezing mechanism and the flat mop plate by pushing or pulling the squeezing mechanism with a single hand. Therefore, the squeezing operation is very strenuous and this approach results in low practicability and low user experience.

At present, there is no mop bucket which is suitable for a flat mop and can achieve both functions of cleaning and squeezing.

SUMMARY

A first technical problem to be solved in the present invention is to provide a mop bucket for cleaning and squeezing a flat mop, which can clean and squeeze a wiper on the flat mop, is integrated both functions of cleaning and squeezing together in one mop bucket, and can provide better cleaning and squeezing effects, and provide a convenient and labor-saving squeezing operation and pleasurable user experience.

A second technical problem to be solved by the present invention is to provide a cleaning tool set capable of cleaning and squeezing a wiper on a flat mop.

To solve the first technical problem, the mop bucket for cleaning and squeezing a flat mop with a wiper and a mop head, comprises a bucket body and a squeezing device disposed inside the bucket body; wherein the bucket body has a squeezing water section and a cleaning section, which are respectively at two different positions when used; when the mop head of the flat mop is removably inserted into the squeezing device, the squeezing device presses against the wiper on the mop head and scrapes the wiper on the mop head.

Preferably, the squeezing device comprises a frame and a squeezer; the frame has a squeezing port for receiving the mop head; the squeezer is disposed adjacent to the squeezing port, so that the squeezer can press the wiper on the mop head to scrape the wiper.

The squeezer can be in various shapes. Preferably, the squeezer is a squeezing strip, a squeezing sheet, or a rotatable squeezing water roller, and the squeezing is fixed on the frame;

or, the squeezer is a squeezing strip, a squeezing sheet, or a rotatable squeezing water roller, and the squeezer is movably connected to the frame via an elastic device;

or, the squeezer is a squeezing strip, a squeezing sheet, or a rotatable squeezing water roller, the frame has an inclined groove, and the squeezer is movably positioned in the groove and can move along the inclined groove.

Preferably, at least one squeezing device is disposed at the cleaning section, and at least one squeezing device is disposed at the squeezing water section.

Preferably, there is only one squeezing device which is disposed in either the squeezing water section or the cleaning section of the bucket body.

There are various methods for forming the cleaning section and the squeezing water section. Preferably, an upward protruding portion extending from the bucket body, which defines the squeezing water section, and the section of the bucket body below the upward protruding portion defines the cleaning section.

Further, preferably, the cleaning section and the squeezing water section are physically independent and separated with each other in the bucket body.

There are various methods for moving the squeezing device to realize the switchover of the squeezing device between the cleaning section and the squeezing water section. As a first preferred implementation, a sliding track is disposed on a top of the bucket body, and the squeezing device can slide on the sliding track and move between the squeezing water section and the cleaning section.

As a second preferred implementation of the switchover of the squeezing device between the cleaning section and the squeezing water section, a turnover frame with a head portion and a tail portion is disposed on the bucket body; the head portion is hinged to a top of the bucket body; the squeezing device is rotatably disposed on the tail portion of the turnover frame; the turnover frame can be positioned and switched between a horizontal state and a vertical state relative to the top of the bucket body, so as to switch the squeezing device between the squeezing water section and the cleaning section.

In order to avoid a direct fierce collision of the mop head with the bottom of the mop bucket when the flat mop is pressed down vigorously, preferably, a buffer for the flat mop is disposed within the squeezing water section and/or the cleaning section of the bucket body.

The structure of the buffer is in various forms. Preferably, the buffer is an elastic cushion, an elastic block or a spring-loaded device, which is disposed on the bottom of the bucket body;

the spring-loaded device comprises an ejected spring with a bottom and a top and a rebound carrier; the bottom of the ejected spring is fixed relative to the bucket body, while the top of the ejected spring presses against the rebound carrier.

Preferably, a plurality of drainage valves corresponding to the cleaning section and/or the squeezing water section are disposed on the bucket body.

Various approaches can be used to ensure the mop head to come into contact with water as little as possible or to keep it free from water during squeezing. As a first preferred implementation, an enclosure frame is disposed within the squeezing water section of the bucket body.

Further preferably, the enclosure frame comprises a upper end surface and a guide port inclined downward on the upper end surface.

As a second preferred implementation of ensuring the mop head to come into contact with water as little as possible or keeping it free from water, a water pumping device is disposed within the squeezing water section of the bucket body, and the water pumping device pumps water out of the squeezing water section.

The water pumping device can be of various structures. As a first preferred implementation, the water pumping device comprises a water pumping cylinder placed on the bottom of the bucket body; a baffle is disposed within the water pumping cylinder to divide the interior of the water pumping cylinder into an upper water pumping section connected to a water pumping pipe and a lower water supply section in communication with the bucket body;

a piston is disposed within the water pumping section and sealed against the water pumping section, and an elastic device is disposed between the piston and the baffle; and a check valve is disposed on the baffle, which is closed when the piston is pressed down and opened when the piston is lifted up.

As a second preferred implementation of the water pumping device, the water pumping device comprises an impeller pump disposed on the bottom of the bucket body, which is connected to the water pumping pipe, an impeller is disposed within the impeller pump, a driving shaft is disposed in a the center of the impeller, and a driving gear is disposed on the driving shaft;

a gear carrier and a lifting rack are disposed within the bucket body, and a duplex gear comprising a bevel gear and a driving gear engaged with the lifting rack is disposed on the gear carrier; and a vertical spindle is disposed on the gear carrier, and an upper gear engaged with the bevel gear and a lower gear engaged with the driving gear are disposed on the spindle.

As a third preferred implementation of ensuring the mop head to come into contact with water as little as possible or keeping it free from water, the squeezing device comprises a squeezing frame disposed in the squeezing water section, a cleaning frame disposed in the cleaning section and two squeezers; the squeezing frame has a squeezing port for receiving the mop head, and the cleaning frame has a cleaning port for receiving the mop head; the two squeezers are respectively disposed adjacent to the squeezing port of the squeezing frame and the cleaning port of the cleaning frame; so that each squeezer can touch the wiper on the mop head to scrape the wiper.

Preferably, the squeezing frame has a water passage extending toward the cleaning section, and the water from the wiper on the mop head squeezed by the squeezer in the squeezing water section flows into the cleaning section through the water passage.

As a fourth preferred implementation of ensuring the mop head to come into contact with water as little as possible or keeping it free from water, the bucket body has a raised step protruding upwardly from bottom of the squeezing water section.

To make the structure of the cleaning bucket more rational, preferably, the squeezing device is disposed in the squeezing water section, and a cleaner is disposed in the cleaning section; the cleaner can move up and down relative to the bucket body, when the wiper on the mop head moves relative to the cleaner, the wiper on the mop head is cleaned for being scrapped between the wiper on the mop head and the cleaner.

Preferably, the movement of the cleaner relative to the bucket body is achieved by hand.

Preferably, the cleaner is driven to move upward when the mop head is pressed down, and the cleaner is driven to move downward when the mop head is pulled upward, so that the relative movement between the cleaner and the mop head is achieved.

Preferably, the cleaner comprises a first frame and a second frame which are separate from each other; a cleaning component is disposed on the first frame or the second frame; a third frame is disposed between the first frame and the second frame; a first rod is hinged at two ends of the first frame, a second rod is hinged at two ends of the second frame, and a third rod close to the first frame and a fourth rod close to the second frame are hinged at two ends of the third frame; the first rod and the third rod are hinged at their lower ends, and the second rod and the fourth rod are hinged at their lower ends; and, during cleaning, a force is applied after the mop head is aligned with the third frame, so that the first frame and the second frame can move upward and downward.

Preferably, the cleaner is connected to a gear-rack mechanism which is driven by the mop head.

Preferably, the squeezing device comprises a squeezer for squeezing the wiper on the mop head and a first support opposite to the squeezer; the squeezer is directly or indirectly disposed on the bucket body, and the first support is directly disposed on the bucket body; the space between the squeezer and the first support is defined as a squeezing space; and, when the mop head is inserted into the squeezing space, the wiper on the mop head can move vertically relatively to the squeezer and be squeezed by the squeezer.

Preferably, the first support is a pair of support ribs longitudinally extending from an end surface of the bucket body; or a pair of support ribs transversely extending from a side surface of the bucket body; or a pair of support frames longitudinally extending from an end surface of the bucket body, with a roller being disposed at a tail end of each of the support frames; or a pair of support frames transversely extending from a side surface of the bucket body, with a roller being disposed on each of the support frames.

Preferably, a water flow device for transferring water from the squeezing water section to the cleaning section is disposed in the squeezing water section.

Preferably, the water flow device is a water flow passenger communicating the squeezing water section and the cleaning section, and the water flow passenger is disposed over the squeezing water section and the cleaning section. In this way, instead of flowing to the bottom of the squeezing water section, the wrung water directly flows to the upper side of the cleaning section from the upper side of the squeezing water section and then flows into the cleaning section.

To make the structure of the squeezing device simpler and to more easily assemble the squeezing device, preferably, the squeezing device is only disposed in the squeezing water section, the squeezing device comprises a squeezer for squeezing the wiper on the mop head and a first support opposite to the squeezer; the squeezer is directly or indirectly disposed on the bucket body, and the first support is disposed on the bucket body; the space between the squeezer and the first support is defined as a squeezing space; when the mop head is inserted into the squeezing space, the wiper on the mop head can move relatively to the squeezer and be squeezed by the squeezer.

Preferably, a cleaning device for cleaning the wiper is disposed within the cleaning section.

Preferably, the first support is a pair of support ribs longitudinally extending from an end surface of the bucket body; or a pair of support ribs transversely extending from a side surface of the bucket body; or a pair of support frames longitudinally extending from an end surface of the bucket body, with a roller being disposed at a tail end of each of the support frames; or a pair of support frames transversely extending from a side surface of the bucket body, with a roller being disposed on each of the support frames.

Preferably, the squeezer is a squeezing roller, a squeezing sheet or a squeezing plate.

Preferably, the squeezing device further comprises a frame disposed on the bucket body, and the squeezer is disposed on the frame.

Preferably, a water flow device for transferring water from the squeezing water section to the cleaning section is disposed in the squeezing water section.

Preferably, the water flow device is a water flow passenger communicating the squeezing water section and the cleaning section, and the water flow passenger is disposed over the squeezing water section and the cleaning section. In this way, instead of flowing to the bottom of the squeezing water section, the wrung water directly flows to the upper side of the cleaning section from the upper side of the squeezing water section and then flows into the cleaning section.

To make the structure of the squeezing device simpler and to more easily assemble the squeezing device, preferably, the squeezing device is only disposed in the squeezing water section, and a cleaning device for cleaning the wiper is disposed within the cleaning section.

Preferably, the cleaning device comprises a cleaner for squeezing and scraping the wiper on the mop head and a second support opposite to the cleaner; the cleaner is directly or indirectly disposed on the bucket body, and the second support is disposed on the bucket body; the space between the cleaner and the second support is defined as a cleaning space; and, when the mop head is inserted into the cleaning space, the wiper on the mop head can move relatively to the cleaner and be squeezed by the cleaner.

Preferably, the second support is a pair of support ribs longitudinally extending from an end surface of the bucket body; or a pair of support ribs transversely extending from a side surface of the bucket body; or a pair of support frames longitudinally extending from an end surface of the bucket body, with a roller being disposed at a tail end of each of the support frames; or a pair of support frames transversely extending from a side surface of the bucket body, with a roller being disposed on each of the support frames; or a pair of support frames longitudinally extending from an end surface of the bucket body, with a pair of springs and a pair of elastic blocks being disposed in each of the support frames, the springs acting on the elastic blocks to allow portions of the elastic blocks to rebound from the tail end of the support frames.

Preferably, the cleaner is a cleaning scraper, a cleaning brush, cleaning teeth or soft cleaning rubber.

Preferably, the cleaning device further comprises a cleaning frame disposed on the bucket body, and the cleaner is disposed on the cleaning frame.

To solve the second technical problem, the cleaning tool set comprises the mop bucket and a flat mop; wherein the flat mop comprises a mop rod and a mop head rotatably attached to the mop rod, and a wiper disposed on the mop head; the wiper is capable of touching the squeezing device on the mop bucket.

Compared with the prior art, the present invention has the following advantages: as the bucket body has a squeezing device, the mop rod can be held by both hands when in use to clean and squeeze the flat mop, thereby realizing the functions of cleaning and squeezing by the relative squeezing and movement between the mop head and the squeezing device; the operation is more labor-saving and simpler; the wiper can be wrung better; moreover, by disposing a mop bucket matched with the flat mop, it is convenient for cleaning and squeezing the flat mop at any time and at any place.

Meanwhile, no additional squeezing mechanism needs to be disposed on the flat mop, so that the mop is simpler in structure and easier to use.

The cleaning tool set of the present invention also has the above said advantages.

DETAILED DESCRIPTION OF THE EMBODIMENTS

To enable a further understanding of the present invention content of the invention herein, refer to the detailed description of the invention and the accompanying drawings below:

Embodiment 1 of the Mop Bucket of the Present Invention

Figure 1:
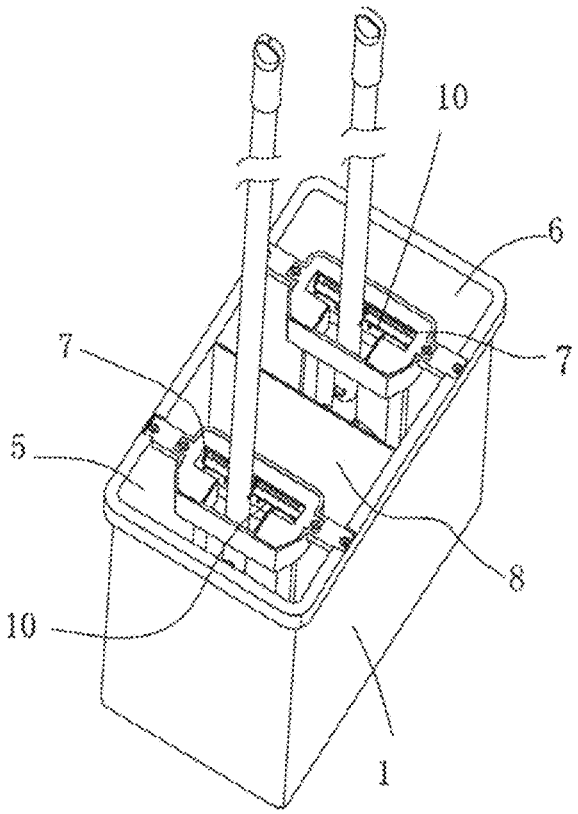
FIG. 1 is a perspective view of a mop bucket according to Embodiment 1 of the present invention.
Figure 2:
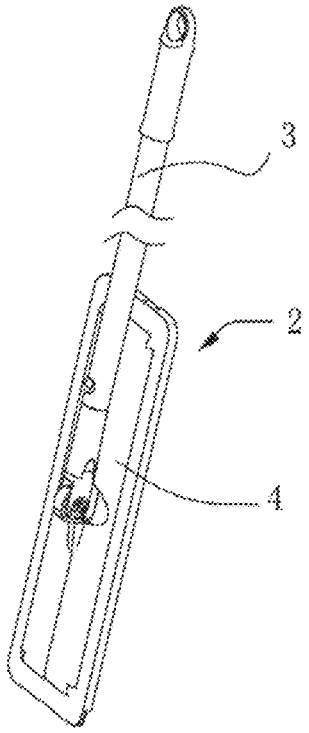
FIG. 2 is a perspective view of a flat mop of the mop bucket according to Embodiment 1 of the present invention.

FIG. 1-FIG. 11 show a first embodiment of the mop bucket for cleaning and squeezing a flat mop. The mop bucket comprises a bucket body 1 and two squeezing devices 7 disposed on the bucket body 1. The bucket body 1 is divided into two volumes, one volume defined as a squeezing water section 5 and the other volume defined as a cleaning section 6, which are separated with each other and respectively located at two different positions, the two squeezing devices 7 are respectively disposed at the squeezing water section 5 and the cleaning section 6. The mop bucket is used together with a flat mop 2; the flat mop 2 comprises a mop rod 3, a mop head 4 rotatably attached to the mop rod 3, and a wiper disposed on the mop head 4. As shown in FIG. 2, the wiper can be disposed on a front surface and/or a rear surface of the mop head 4. When the mop head 4 of the flat mop 2 is removably inserted into one of squeezing device 7, the squeezing device 7 presses against the wiper on the mop head 4 and scrapes the wiper on the mop head 4 repetitively, so as to clean the wiper or make the wiper be squeezed.

The detail structure of the squeezing device 7 can be anyone of the following six embodiments.

Embodiment 1 of the Squeezing Device of the Present Invention

Figure 3:
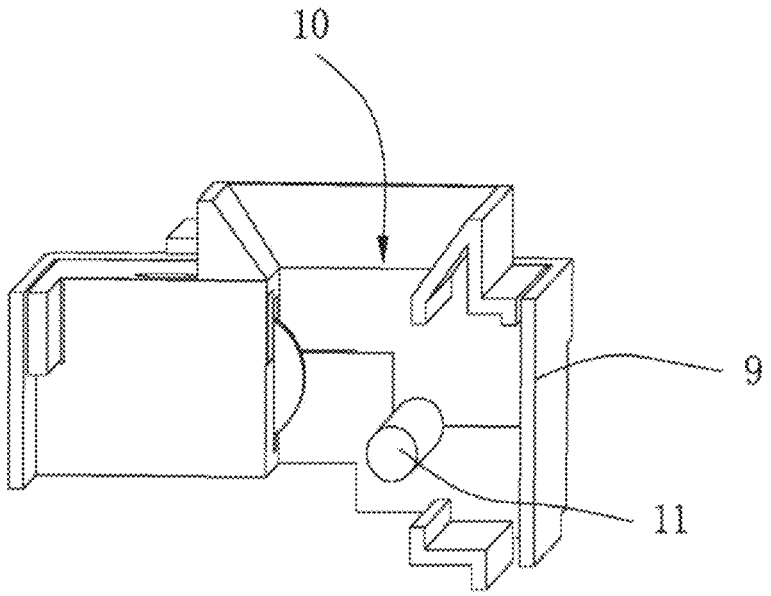
FIG. 3 is a perspective view showing the structure of a squeezing device according to Embodiment 1 of the present invention.

FIG. 3 shows a first embodiment of the squeezing device, the squeezing device 7 comprises a frame 9 and a squeezer 11; the frame 9 has a squeezing port 10 for receiving the mop head 4. The squeezer 11 is disposed adjacent to the squeezing port 10 and exposed out of the squeezing port 10. In this embodiment, the squeezer 11 is a squeezing roller which is fixed on the squeezing port 10. That is, the width of the squeezing port 10 remains unchanged. After the mop head 4 is inserted into the squeezing port 10, the squeezer 11 can press the wiper on the mop head 4 to scrape the wiper.

Embodiment 2 of the Squeezing Device of the Present Invention

Figure 4:
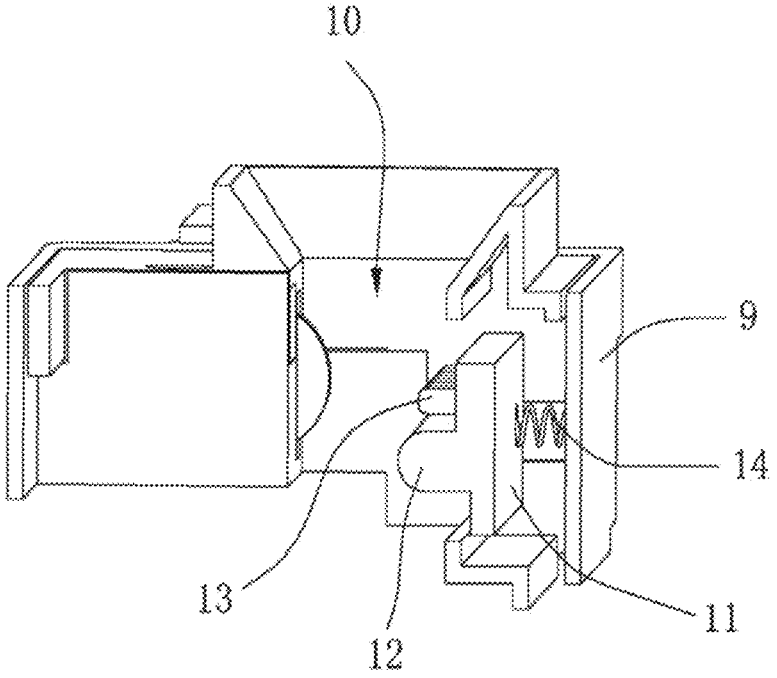
FIG. 4 is a perspective view showing the structure of a squeezing device according to Embodiment 2 of the present invention.

FIG. 4 shows Embodiment 2 of the squeezing device, the difference between the squeezing device of Embodiment 2 and of Embodiment 1 is that, the squeezer 11 is a squeezing strip movably connected to the squeezing port 10. That is, during cleaning and squeezing, the width of the squeezing port 10 can be changed by moving the squeezing strip, so that the wiper on the mop head 4 is scraped. Specifically, the squeezing strip is movably connected to the squeezing port 10 of the frame 9 via an elastic device which is a spring 14. That is, the squeezing strip is connected to the frame 9 via the spring 14, so that the squeezer 11 is somewhat elastic. Meanwhile, a squeezing strip 12 and a brush column 13 are disposed on the squeezing strip. The cross-section of the squeezing strip 12 is approximately arch-shaped. The squeezing strip 12 plays a primary squeezing role, and the brush column 13 plays an auxiliary squeezing role. During squeezing, the mop head 4 can be more smoothly inserted into the squeezing port 10 and the wiper on the mop head 4 can be squeezed by the squeezing strip 12 and the brush column 13, so that the wiper on the mop head 4 can be better cleaned and wrung.

Embodiment 3 of the Squeezing Device of the Present Invention

Figure 5:
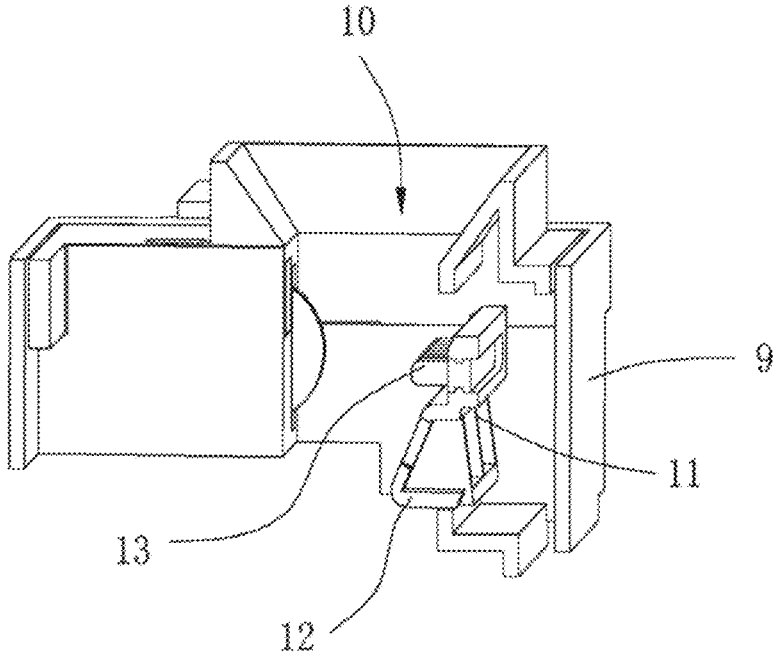
FIG. 5 is a perspective view showing the structure of a squeezing device according to Embodiment 3 of the present invention.

FIG. 5 shows Embodiment 3 of the squeezing device, the difference between the squeezing device of Embodiment 3 and of Embodiment 1 is that, the squeezer 11 is a squeezing strip fixed on the frame 9. Specifically, a squeezing strip 12 and a brush column 13 are disposed on the squeezing strip, and the cross-section of the squeezing strip 12 is approximately U-shaped.

Embodiment 4 of the Squeezing Device of the Present Invention

Figure 6:
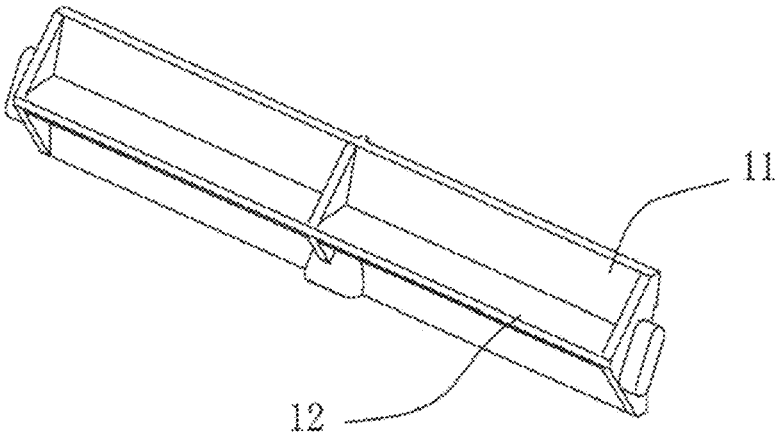
FIG. 6 is a perspective view showing the structure of a squeezing device according to Embodiment 4 of the present invention.

FIG. 6 shows Embodiment 4 of the squeezing device, the difference between the squeezing device of Embodiment 4 and of Embodiment 1 is that, the squeezer 11 is a squeezing strip disposed in the squeezing port 10. Specifically, a squeezing strip 12 is disposed on the squeezing strip, and the squeezing strip 12 is a squeezing ridge.

Embodiment 5 of the Squeezing Device of the Present Invention

Figure 7:
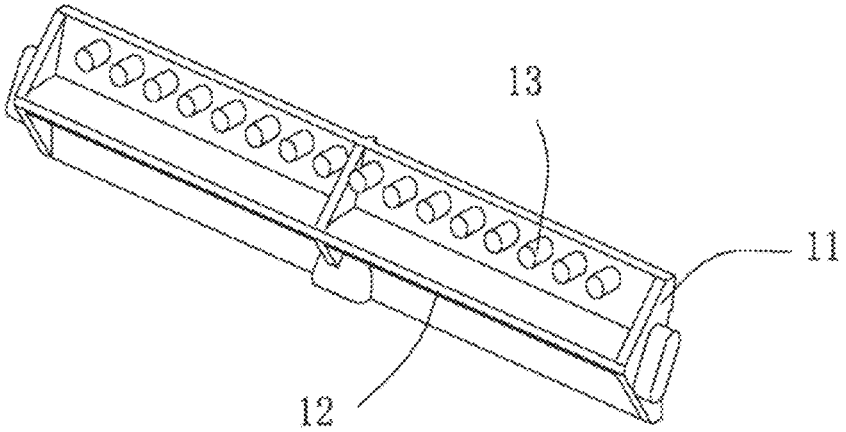
FIG. 7 is a perspective view showing the structure of a squeezing device according to Embodiment 5 of the present invention.

FIG. 7 shows Embodiment 5 of the squeezing device, the difference between the squeezing device of Embodiment 5 and of Embodiment 4 is that, a brush column 13 is disposed on the squeezing strip.

Embodiment 6 of the Squeezing Device of the Present Invention

Figure 8:
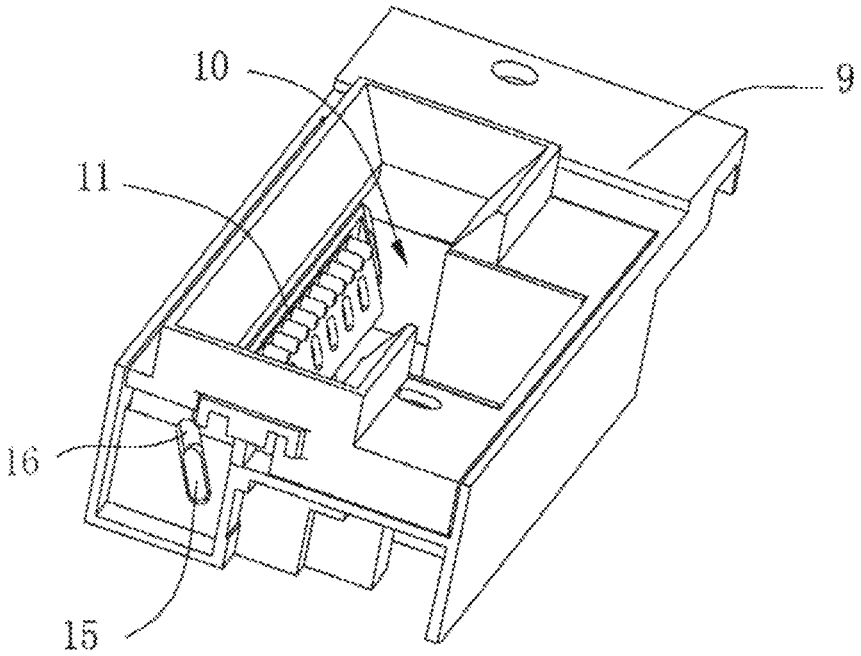
FIG. 8 is a perspective view showing the structure of a squeezing device according to Embodiment 6 of the present invention.

FIG. 8 shows Embodiment 6 of the squeezing device, the difference between the squeezing device of Embodiment 6 and of Embodiment 2 is the movably mounting manner of the squeezer. That is, the frame 9 has an inclined groove, and the squeezer 11 is movably positioned in the groove and can move along the inclined groove, so that the way of changing the width of the squeezing port is different. Specifically, the squeezer 11 is a squeezing strip; protruded sliders 15 are disposed at two ends of the squeezing strip; and correspondingly, an oblique slide rail 16 matched with the sliders 15 are disposed on the frame 9; the sliders 15 are disposed in the oblique slide rail 16 and can slide within the oblique slide rail 16 so as to move the squeezer 11, so that the width of the squeezing port 10 can be changed during cleaning and squeezing of the mop head 4.

In this embodiment, a baffle 8 is disposed inside the bucket body 1 so that the cleaning section 6 and the squeezing water section 5 are physically separated with each other in the bucket body 1. At least one squeezing device 7 is disposed at the cleaning section 6, and at least one squeezing device 7 is disposed at the squeezing water section 5. As shown in FIG. 1, one squeezing device 7 is disposed at each of the cleaning section 6 and the squeezing water section 5, wherein the squeezing device 7 within the cleaning section 6 is used for squeezing and cleaning the wiper on the mop head 4 and the squeezing device 7 within the squeezing water section 5 is used for squeezing and squeezing the wiper on the mop head 4.

Figure 9:
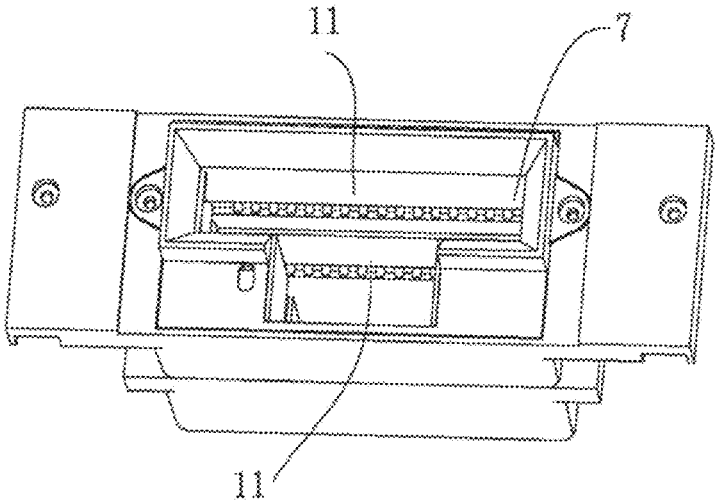
FIG. 9 is a perspective view of the arrangement of two squeezing devices of Embodiment 6 in the mop bucket according to Embodiment 1 of the present invention.

As shown in FIG. 9, two squeezing devices 7 of Embodiment 6 are disposed at the cleaning section 6 and the squeezing water section 5, and the two squeezing devices 7 are arranged in parallel and located on two sides of the squeezing port 10, respectively, so that the cleaning and squeezing effects are enhanced.

Figure 10:
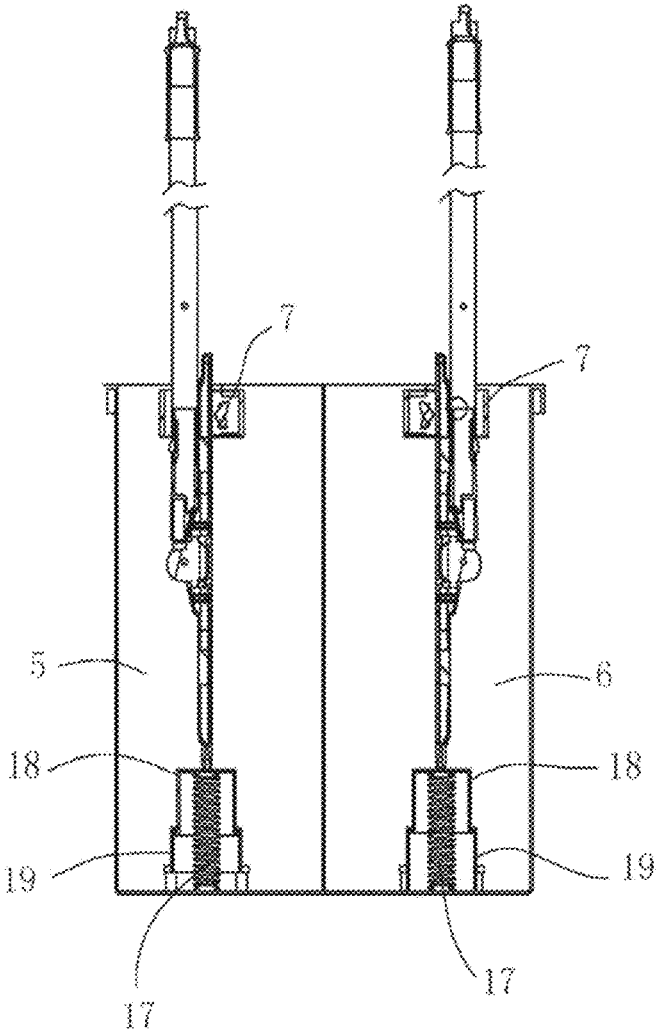
FIG. 10 is a schematic view of a buffer of the mop bucket according to Embodiment 1 of the present invention.

In order to prevent the mop head 4 of the flat mop 2 from directly coming into contact with the bottom of the mop bucket, a buffer for the flat mop 2 is disposed within the squeezing water section 5 and/or the cleaning section 6 of the bucket body 1. As shown in FIG. 10, the buffer is a spring-loaded device disposed on a bottom of the bucket body 1; the spring-loaded device comprises an ejected spring 17 with a lower end and an upper end and a rebound carrier 18; a fixed sleeve 19 is disposed on the bottom of the cleaning section 6 and the squeezing water section 5, and the rebound carrier 18 is sheathed within the fixed sleeve 19; the bottom of the ejected spring 17 is fixed relative to the bucket body 1, while the top of the ejected spring 17 presses against the rebound carrier. During cleaning and squeezing, the mop head 4 is ejected onto the rebound carrier 18 so that the mop head is cushioned by the elasticity of the ejected spring 17.

Figure 11:
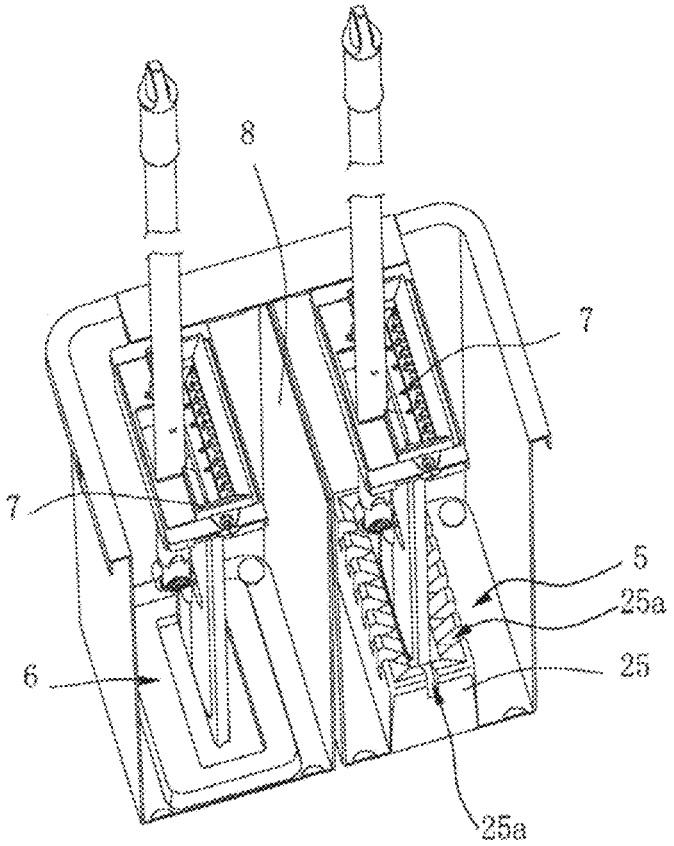
FIG. 11 is a perspective view of a squeezing water section with an enclosure frame according to Embodiment 1 of the present invention.

During squeezing within the squeezing water section 5, the wrung water is retained within the squeezing water section 5, so that a certain water level is formed within the squeezing water section 5. In order to prevent the mop head 4 from coming into contact with the wrung water during squeezing to influence the squeezing effect, as shown in FIG. 11, an enclosure frame 25 is disposed on the bottom of the squeezing water section 5, and the enclosure frame 25 further comprises a upper end surface and a guide port 25*a* inclined downward on the upper end surface. In this way, during squeezing, the mop head 4 is pressed down and inserted into the enclosure frame 25; a very large amount of the wrung water falls outside the enclosure frame 25, with only a very small amount of water falling into the enclosure frame 25; and the wiper on the mop head 4 absorb this very small amount of water again. In this way, after multiple repetitions of squeezing, the wiper is wrung better.

In practical applications, the mop head 4 is rotated to a cleaning and squeezing state, that is, the mop head 4 is rotated to be parallel to the mop rod 3 (or not parallel to the mop rod 3), so that the mop head 4 is inserted into the squeezing port 10. Specifically, in the cleaning state, the mop head 4 is moved and squeezed between the cleaning section 6 and the squeezer 11 of the squeezing device 7 so as to squeeze and clean the wiper. In the squeezing state, the mop head 4 is moved and squeezed between the squeezing water section 5 and the squeezer 11 of the squeezing device 7 so as to squeeze and squeeze the wiper. In addition, when the mop head 4 is pressed down, the mop head directly comes into contact with the buffer, so that the mop head 4 can be prevented from directly coming into contact with the bottom of the bucket body 1. Accordingly, the mop head is cushioned, and it is more convenient for the cleaning and squeezing operations.

In order to achieve better cleaning and squeezing effects, generally, the mop head 4 moves vertically relatively to the squeezing device 7, that is, the mop head 4 moves up and down in its axial direction. Therefore, relative movement is generated between the mop head 4 and the squeezing device 7, so that the wiper on the mop head 4 moves in relative to and against the squeezer 11 of the squeezing device 7 for cleaning or squeezing. During cleaning or squeezing, the mop rod 3 can be held and pressed down by two hands, so that the operation is very convenient and labor-saving.

To easily rotate the mop head 4, a counter weight for assisting in rotating the mop head 4 is disposed on the mop head 4 so that the mop head 4 can be rotated more easily due to the gravity of the counter weight.

Embodiment 2 of the Mop Bucket of the Present Invention

Figure 12:
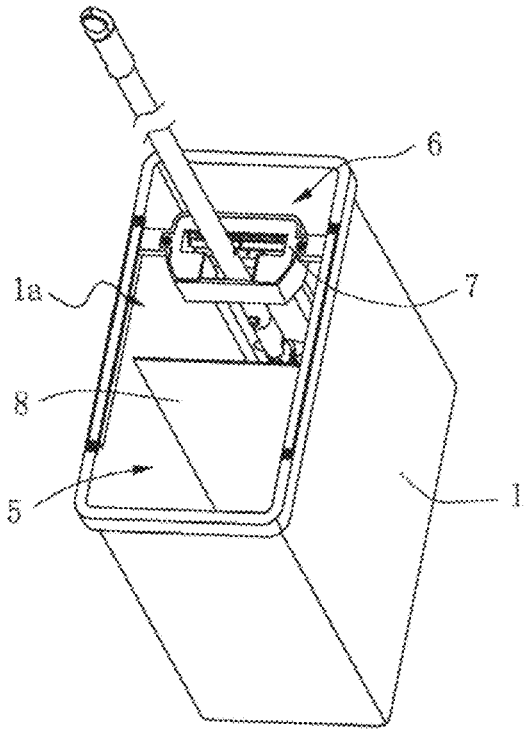
FIG. 12 is a perspective view of a mop bucket according to Embodiment 2 of the present invention (when the squeezing device is located within the cleaning section)
Figure 13:
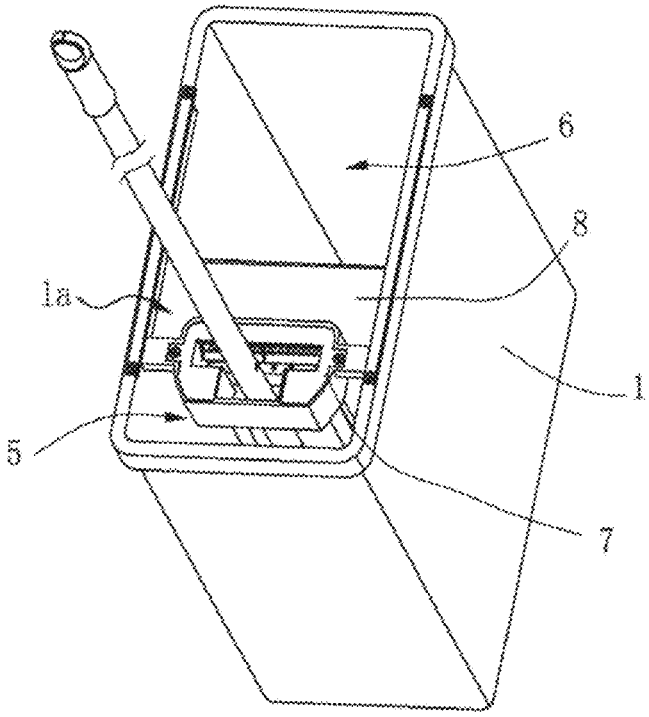
FIG. 13 is a perspective view of the mop bucket according to Embodiment 2 of the present invention (when the squeezing device is located within the squeezing water section)

FIG. 12-FIG. 13 show a second embodiment of the mop bucket for cleaning and squeezing a flat mop. The difference between this embodiment and Embodiment 1 of the mop bucket is that, there is only one squeezing device 7 which is disposed in either the squeezing water section 5 or the cleaning section 6 of the bucket body 1. Specifically, a sliding track 1*a* is disposed on a top of the bucket body 1, and the squeezing device 7 can slide on the sliding track 1*a* and move between the squeezing water section 5 and the cleaning section 6, so that the switchover of the squeezing device 7 between the squeezing water section 5 and the cleaning section 6 is realized.

Embodiment 3 of the Mop Bucket of the Present Invention

Figure 14:
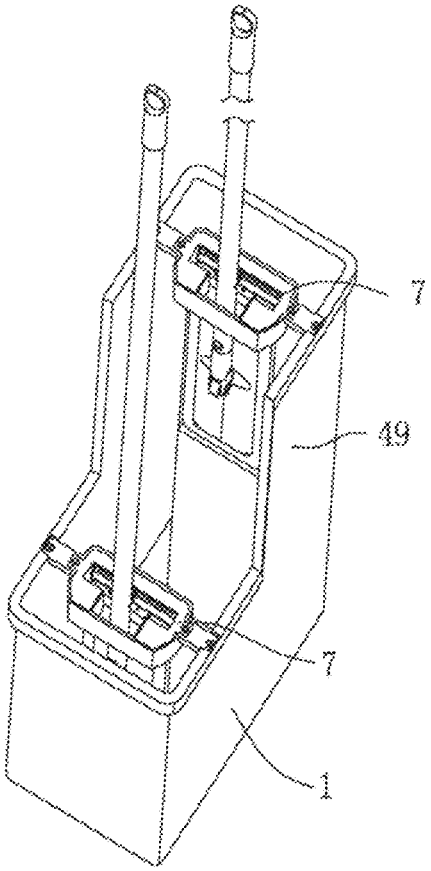
FIG. 14 is a perspective view of a mop bucket according to Embodiment 3 of the present invention.

FIG. 14 shows a third embodiment of the mop bucket for cleaning and squeezing a flat mop. The difference between this embodiment and Embodiment 1 of the mop bucket is the forming structure of the cleaning section 6 and the squeezing water section 5. Specifically, an upward protruding portion 49 extending from the bucket body 1, which defines the squeezing water section 5, and the section of the bucket body 1 below the upward protruding portion 49 defines the cleaning section 6.

Embodiment 4 of the Mop Bucket of the Present Invention

Figure 15:
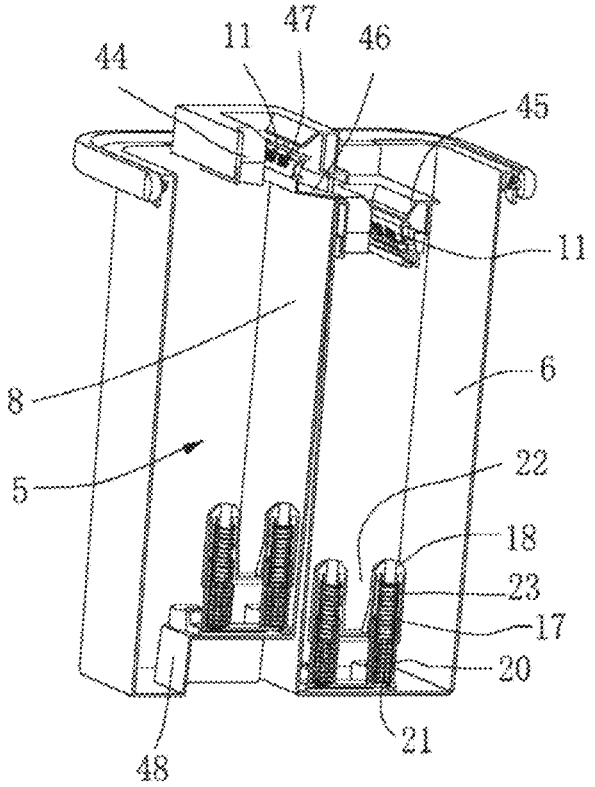
FIG. 15 is a perspective view of a mop bucket according to Embodiment 4 of the present invention.

FIG. 15 shows a forth embodiment of the mop bucket for cleaning and squeezing a flat mop. The difference between this embodiment and Embodiment 1 of the mop bucket is that, the manner for mounting the ejected spring 17 and the rebound carrier 18 in the buffer on the bottom of the bucket body and the approach for ensuring the mop head to come into contact with little water or to keep it free from water during squeezing. In this embodiment, the buffer comprises an ejected spring 17 with a bottom and a top and a rebound carrier 18, the bucket body 1 has a raised step 48 protruding upwardly from bottom of the squeezing water section 5, and buffers are disposed on the bottom of the cleaning section 6 and on the raised step 48. Specifically, two fixed spring sleeves 20 are disposed on the bottom of the cleaning section 6 and on the raised step 48; a fixed guide column 21 is disposed within each of the spring sleeves 20; the cross-section of the rebound carrier 18 is roughly M-shaped; and, the rebound carrier 18 has a recessed portion 181 capable of accommodating the mop head 4. That is, the mop head 4 can resist against the recessed portion 181 when it is pressed down. Guide tips are formed on two sides of the recessed portion 181, respectively; and guide sleeves 23 are sheathed on the guide tip; the guide sleeves 23 are sheathed outside the guide columns 21; the ejected springs 17 are sheathed outside the guide sleeves 23 and the guide columns 21; and, the bottoms of the ejected springs 17 are resisted against the bottom of the bucket body 1, while the tops thereof are resisted against the guide tips. In this embodiment, a water accumulating interlayer for containing water wrung during squeezing is formed around the raised step 48. The mop head 4 can only move down to the recessed portion of the rebound carriers 18 above the raised step 48, so that the mop head will not come into contact with the accumulated water.

Embodiment 5 of the Mop Bucket of the Present Invention

Figure 16:
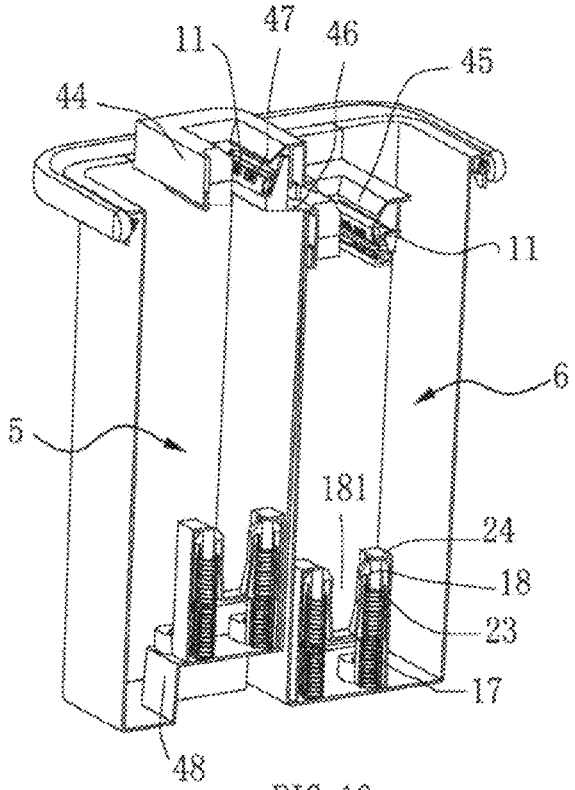
FIG. 16 is a perspective view of a mop bucket according to Embodiment 5 of the present invention.

FIG. 16 shows a fifth embodiment of the mop bucket for cleaning and squeezing a flat mop. The difference between this embodiment and Embodiment 4 of the mop bucket is, the manner for mounting the ejected spring 17 and the rebound carrier 18 in the buffer on the bottom of the bucket body. Specifically, the buffer comprises an ejected spring 17 with a bottom and a top and a rebound carrier 18, two fixed guide frames 24 are disposed on the bottom of the squeezing water section 5 and the cleaning section 6, and the rebound carrier 18 has a recessed portion 22. The mop head 4 is resisted against the recessed portion 22 when it is pressed down. Guide tips are formed on two sides of the recessed portion 22, respectively. The guide tips are located within the guide frames 24, and guide sleeves 23 are disposed within the guide tips. The ejected spring 17 is sheathed outside the guide sleeves 23, and the bottom of the ejected spring 17 is resisted against the bottom of the bucket body 1 while the top thereof is resisted against the guide tips.

Embodiment 6 of the Mop Bucket of the Present Invention

Figure 17:
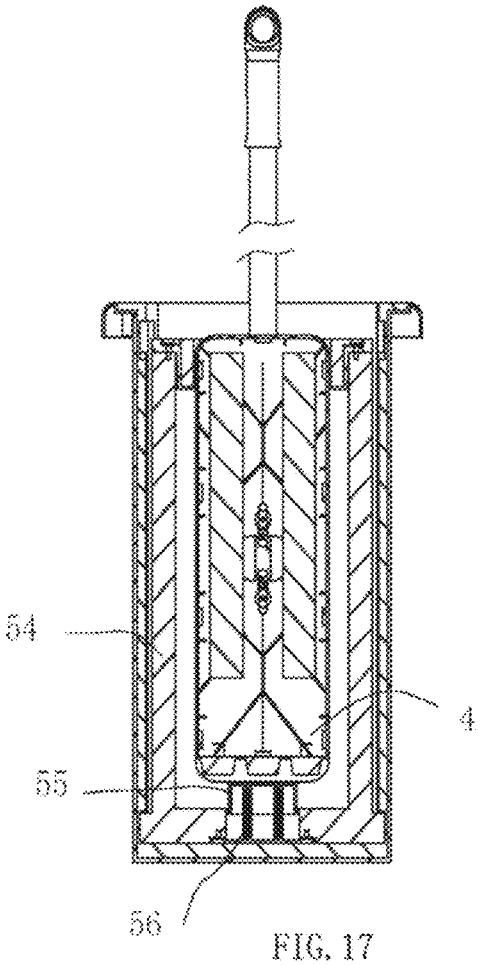
FIG. 17 is a perspective view of a mop bucket according to Embodiment 6 of the present invention.

FIG. 17 shows a sixth embodiment of the mop bucket for cleaning and squeezing a flat mop. The difference between this embodiment and Embodiment 1 of the mop bucket is the buffer. Specifically, the buffer comprises a lifting frame 54, a cushion piston 55 and a cushion spring 56, wherein a cushion notch is formed on the bottom of the lifting frame 54; both the cushion piston 55 and the cushion spring 56 are disposed within the cushion notch; and, one end of the cushion spring 54 is resisted against the cushion piston 55, while the other end thereof is resisted against the bottom of the cushion notch. During squeezing or cleaning, the mop head 4 can be resisted against the cushion piston 55 to be cushioned.

Embodiment 7 of the Mop Bucket of the Present Invention

FIG. 18-FIG. 21 show a seventh embodiment of the mop bucket for cleaning and squeezing a flat mop. The difference between this embodiment and Embodiment 1 of the mop bucket is that, the approach for ensuring the mop head to come into contact with little water or keeping it free from water during squeezing is different. Specifically, the water pumping device comprises a water pumping cylinder 27 placed on the bottom of the bucket body 1; a baffle 28 is disposed within the water pumping cylinder 27 to divide the interior of the water pumping cylinder into an upper water pumping section 29 connected to a water pumping pipe and a lower water supply section 30 in communication with the bucket body 1; a piston 31 is disposed within the water pumping section 29 and sealed against the water pumping section 29, and an elastic device is disposed between the piston 31 and the baffle 28; a check valve is disposed on the baffle 28, which is closed when the piston 31 is pressed down and opened when the piston 31 is lifted up.

In this embodiment, the elastic device is a water pumping spring 32; the check valve is a valve plate 33 pivoted to an upper surface of the baffle 28; and, a flowing hole 34 is formed on the baffle 28, and the valve plate 33 can occlude the flowing hole 34. The flowing hole In practical applications, the mop head 4 is moved down to press down the piston 31. In this case, the volume of the water pumping section 29 is decreased, the valve plate 33 occludes the flowing hole 34 due to water pressure, and water within the water pumping section 29 is drained by the water pumping pipe. When the mop head 4 is moved up, the volume of the water pumping section 29 is increased, water within the squeezing water section flows through the water supply section 30, opens the valve plate and enters the water pumping section 29. Of course, it is possible that another portion of the flat mop 2 or a specially designed component can interact with the piston 31.

Embodiment 8 of the Mop Bucket of the Present Invention

Figure 22:
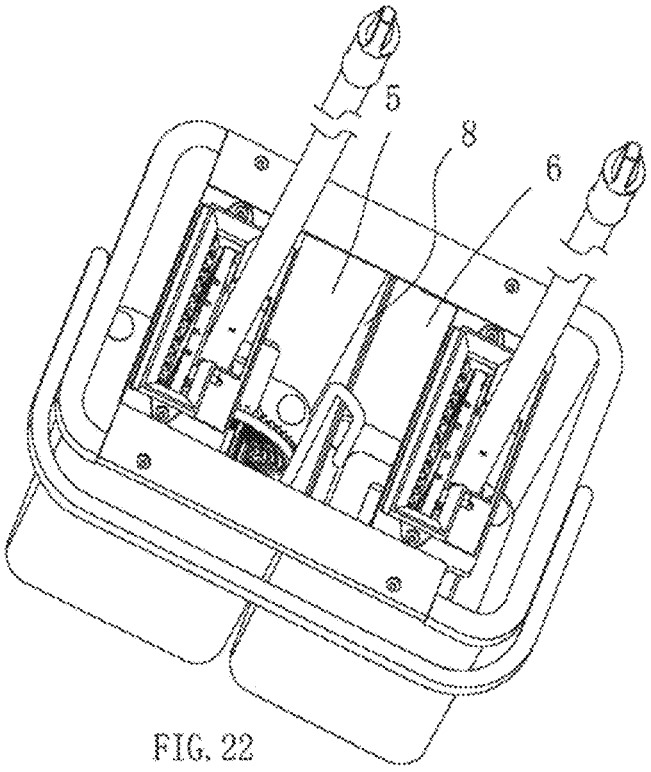
FIG. 22 is a perspective view of a mop bucket according to Embodiment 8 of the present invention.
Figure 18:
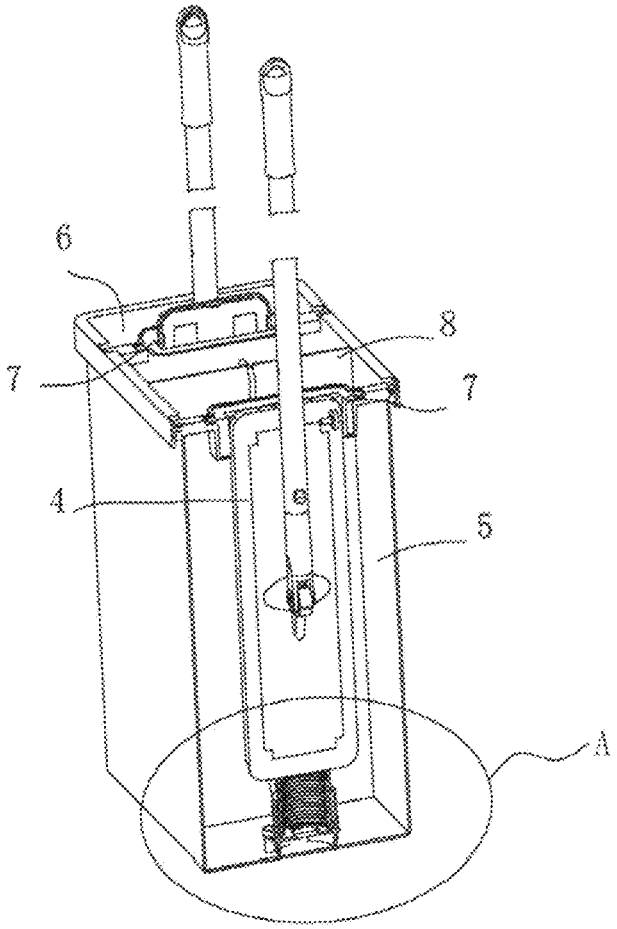
FIG. 18 is a perspective view of a mop bucket according to Embodiment 7 of the present invention (when the valve plate occludes the flowing hole)
Figure 20:
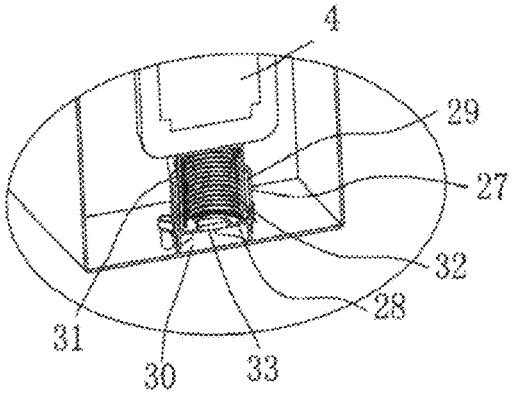
FIG. 20 is an enlarged view of part A of FIG. 18.
Figure 19:
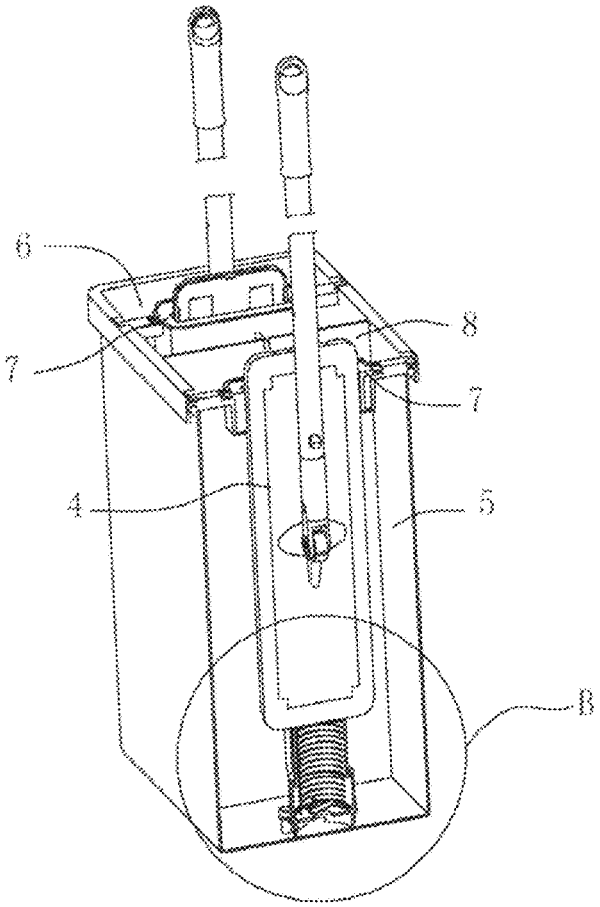
FIG. 19 is a perspective view of the mop bucket according to Embodiment 7 of the present invention (when the valve plate is opened)
Figure 21:
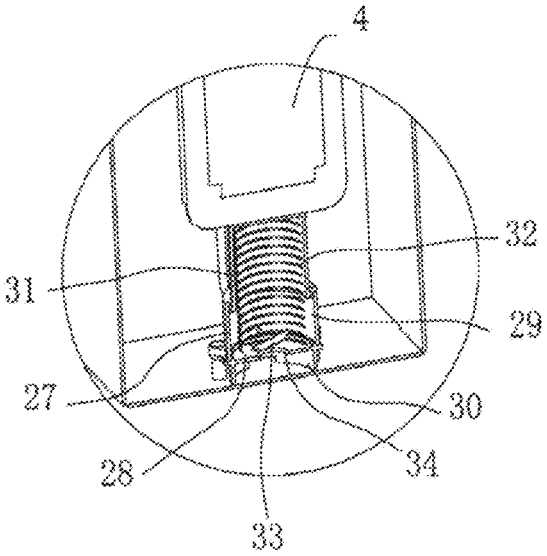
FIG. 21 is an enlarged view of part B of FIG. 19.
Figure 23:
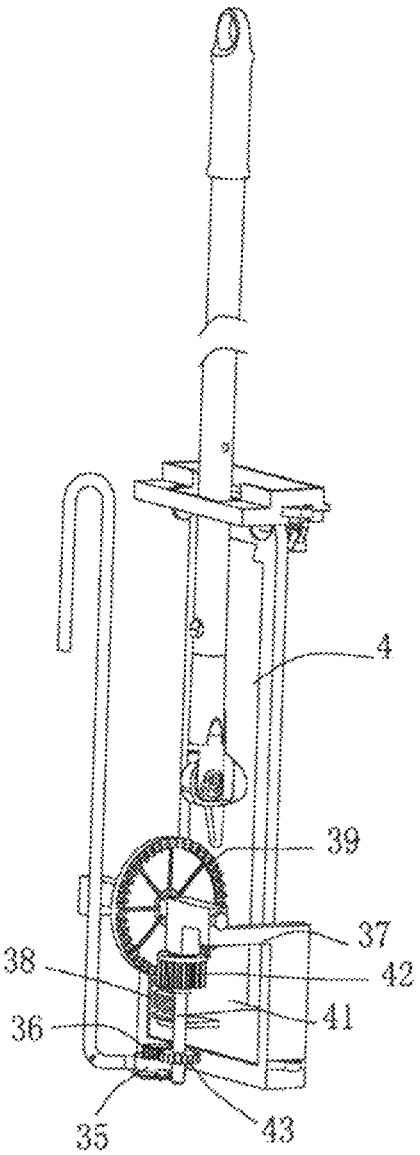
FIG. 23 is a perspective view when a lifting rack in a water pumping device of FIG. 22 is moving downward.
Figure 24:
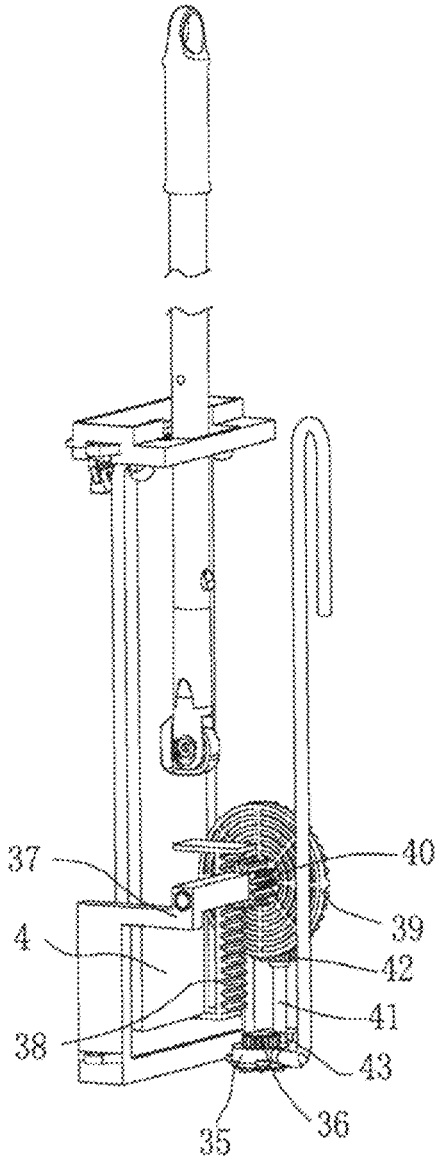
FIG. 24 is a perspective view when the lifting rack in the water pumping device of FIG. 22 is returning to the original position.

FIG. 22-FIG. 24 show an eighth embodiment of the mop bucket for cleaning and squeezing a flat mop. The difference between this embodiment and Embodiment 1 of the mop bucket is that, the approach for ensuring the mop head to come into contact with little water or keeping it free from water during squeezing is different. Specifically, the water pumping device comprises an impeller pump 35 arranged on the bottom of the bucket body 1, which is connected to the water pumping pipe, an impeller is disposed within the impeller pump 35; driving shaft is disposed in the center of the impeller, and a driving gear 36 is disposed on the driving shaft; a gear carrier 37 and a lifting rack 38 capable of being driven by the flat mop are disposed within the bucket body 1; and a duplex gear comprising a bevel gear 39 and a driving gear 40 engaged with the lifting rack 38 is disposed on the gear carrier 37; a vertical spindle 41 is disposed on the gear carrier 37, and an upper gear 42 engaged with the bevel gear 39 and a lower gear 43 engaged with the driving gear 36 are disposed on the spindle 41. In this embodiment, a rack return spring can be further disposed on the bottom of the bucket body 1. The gear return spring is resisted against the lifting gear 38 so that the mop head 4 is moved up to return to the original position.

In practical applications, the mop head 4 is moved down to push the lifting rack 38 to lower down. The lowering of the lifting gear 38 drives the driving gear 40 to rotate, the rotation of the driving gear 40 drives the bevel gear 39 to rotate, and the rotation of the bevel gear 39 drives the upper gear 42 to rotate. In this way, the spindle 41 is rotated, and the upper gear 43 is rotated. The rotation of the lower gear 43 drives the driving gear 36 to rotate so as to drive the impeller to rotate to pump water, so that water is drained through the water pumping pipe.

Embodiment 9 of the Mop Bucket of the Present Invention

Figure 25:
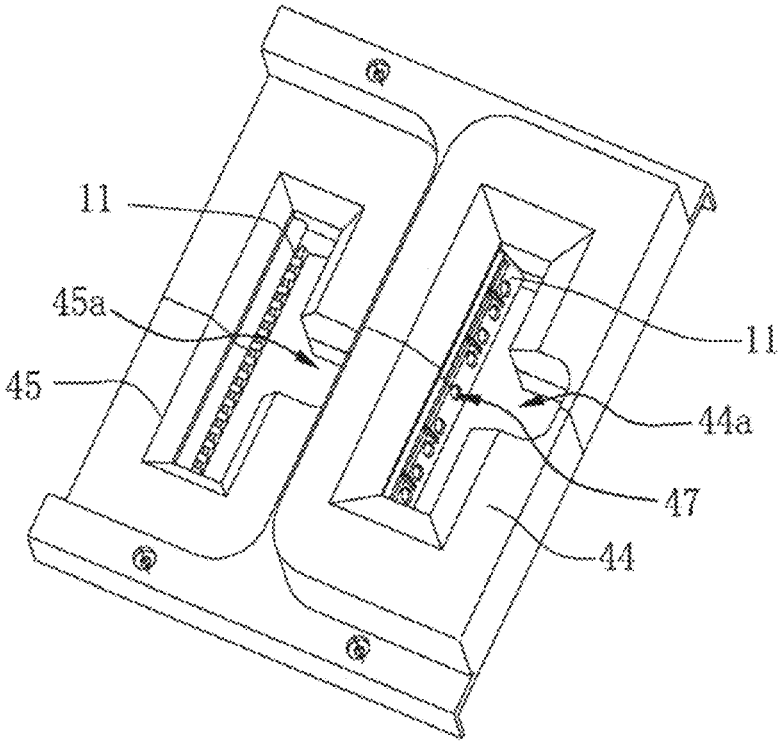
FIG. 25 is a perspective view of a mop bucket according to Embodiment 9 of the present invention.
Figure 26:
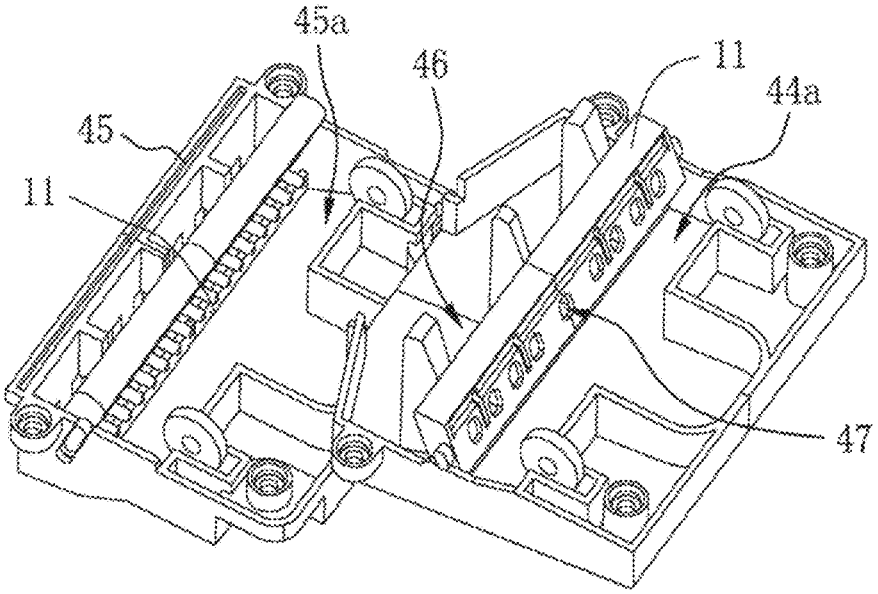
FIG. 26 is a perspective view of FIG. 25, when viewed from another perspective.
Figure 27:
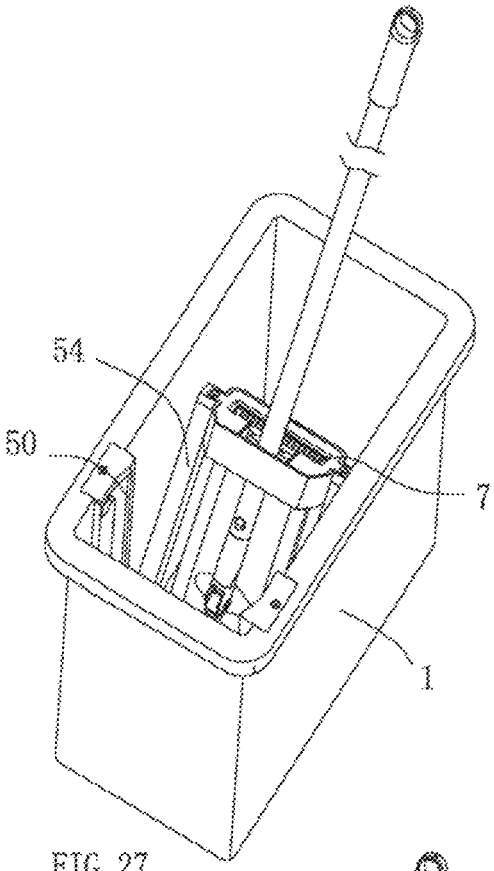
FIG. 27 is a perspective view of a mop bucket according to Embodiment 10 of the present invention (when the squeezing device is disposed within the cleaning section)
Figure 28:
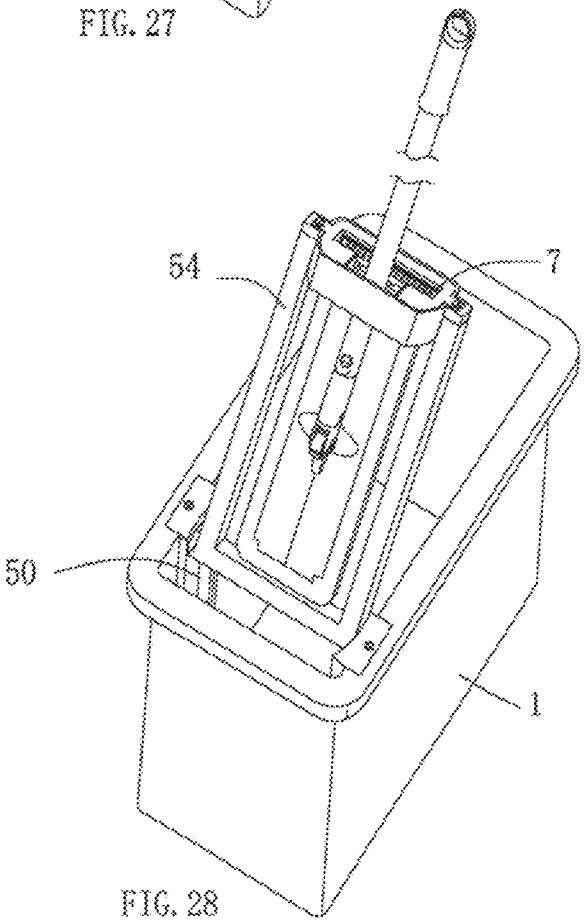
FIG. 28 is a perspective view of a mop bucket according to Embodiment 10 of the present invention (when the squeezing device is disposed within the squeezing water section)
Figure 29:
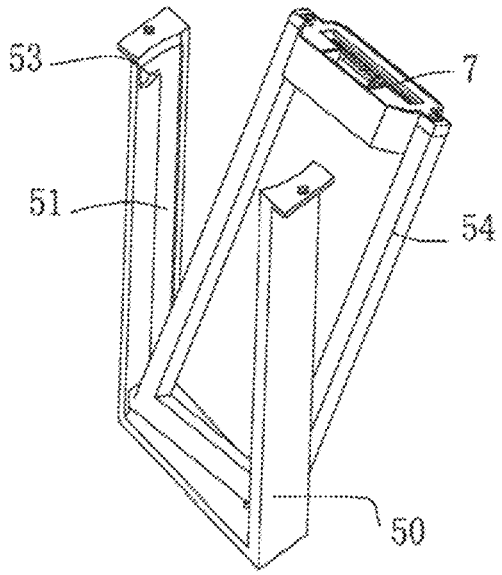
FIG. 29 is a perspective view when the squeezing device of FIG. 27 is disposed at a lower position.
Figure 30:
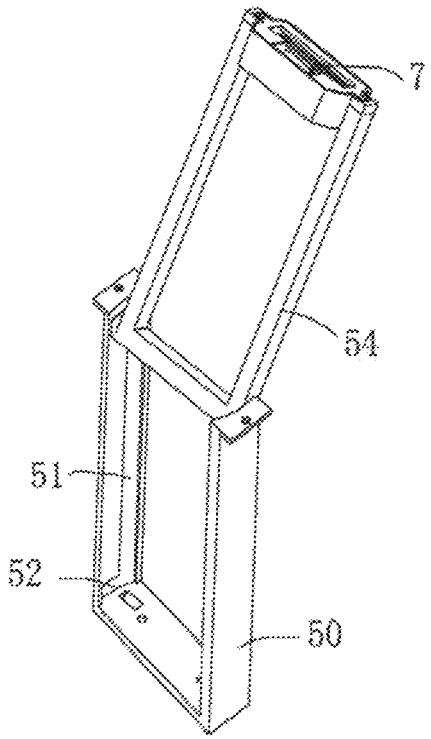
FIG. 30 is a perspective view when the squeezing device of FIG. 27 is disposed at an upper position.

FIG. 25-FIG. 26 show a ninth embodiment of the mop bucket for cleaning and squeezing a flat mop. The difference between this embodiment and Embodiment 1 of the mop bucket is that, the approach for ensuring the mop head to come into contact with little water or keeping it free from water during squeezing is different. Specifically, the squeezing device 7 comprises a squeezing frame 44 disposed in the squeezing water section 5, a cleaning frame 45 disposed in the cleaning section 6 and two squeezers 11; the squeezers 11 for squeezing the wiper on the mop head 4 are disposed in both the squeezing frame 44 and the cleaning frame 45; the squeezing frame 44 has a squeezing port 44*a* for receiving the mop head 4, and the cleaning frame 45 has a cleaning port 45*a* for receiving the mop head 4; the two squeezers 11 are respectively disposed adjacent to the squeezing port 44*a* of the squeezing frame 44 and the cleaning port 45*a* of the cleaning frame 45; so that each squeezer 11 can touch the wiper on the mop head 4 to scrape the wiper. In this embodiment, the squeezers 11 are protruded from edges of the squeezing port 10 and the cleaning port 45*a*. After the mop head 4 is inserted into the squeezing port 10/the cleaning port 45*a*, the squeezers 11 can touch the wiper on the mop head 4 so as to clean and squeeze the wiper by repeatedly scraping it by relative movement.

As shown in FIG. 26, the frame 44 has a water passage 46 extending toward the cleaning section 6, and water squeezed by scraping the wiper on the mop head 4 by the squeezer 11 within the squeezing water section flows through the water passage 46 to the cleaning section 6. In this embodiment, the tail end of the water passage 46 is communicated with the cleaning frame 45, and the squeezers 11 are squeezing strips with water ports 47 formed thereon. The water ports 47 form water inlets of the water passage 46, and the squeezed water flows into the water passage 46 through the water ports 47. In this structure design, a very large amount of the squeezed water directly flows through the water passage 46 to the cleaning section 6, so that the amount of water falling into the squeezing water section 5 is decreased.

Embodiment 10 of the Mop Bucket of the Present Invention

FIG. 27-FIG. 30 show a tenth embodiment of the mop bucket for cleaning and squeezing a flat mop. The difference between this embodiment and Embodiment 1 of the mop bucket is that, the bucket body 1 only has one squeezing device 7 and one section (volume) which simultaneously serves as the cleaning section 6 and the squeezing water section 5. The squeezing device 7 is switched between the cleaning state and the squeezing state. When the squeezing device is in a first state, the space inside the bucket body 1 serves as the cleaning section 5; and when the squeezing device is in a second state, the space inside the bucket body 1 serves as the squeezing water section 6. Specifically, a U-shaped rail rack 50 having an upward opening and a lifting frame 54 are disposed in the bucket body 1, wherein two vertical rail slots 51 are disposed on the U-shaped rail rack 50; lower positioning grooves 52 extending transversely are disposed at lower ends of the rail slots 51, while upper positioning grooves 53 extending transversely are disposed at upper ends of the rail slots 51; and, lifting heads are disposed at lower ends on two sides of the lifting frame 54, the lifting heads are disposed within the rail slots 51, and the squeezing device 7 is disposed at an upper end of the lifting frame 54.

When the lifting frame 54 is located at a lower position, the lifting heads slide into and are positioned in the lower positioning grooves 52. In this case, the space within the bucket body 1 serves as the cleaning section, and the mop head 4 moves back and forth to realize movement in relative to the squeezing device 7 for the purposes of squeezing and cleaning. When the lifting frame 54 is located at an upper position, the lifting heads slide into and are positioned in the upper positioning grooves 53. In this case, a section of the lifting frame 54 above the bucket body 1 serves as the squeezing water section, and the mop head 4 moves back and forth to realize movement in relative to the squeezing device 7 for the purposes of squeezing and squeezing.

Embodiment 11 of the Mop Bucket of the Present Invention

Figure 31:
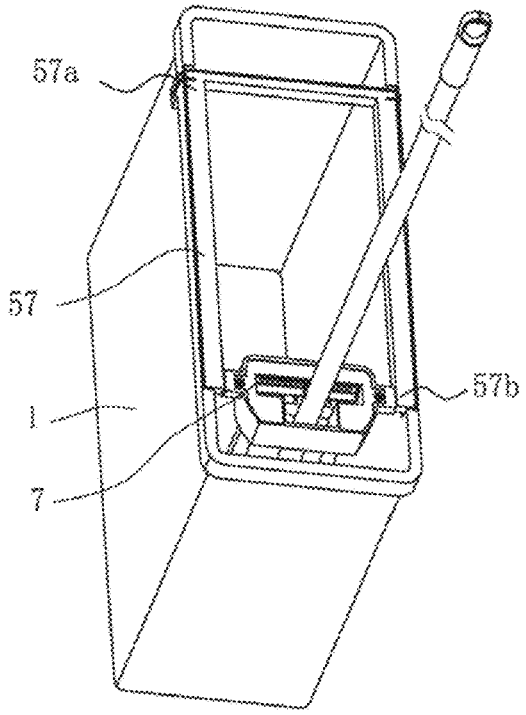
FIG. 31 is a perspective view of a mop bucket according to Embodiment 11 of the present invention (when the squeezing device is disposed within the cleaning section)
Figure 32:
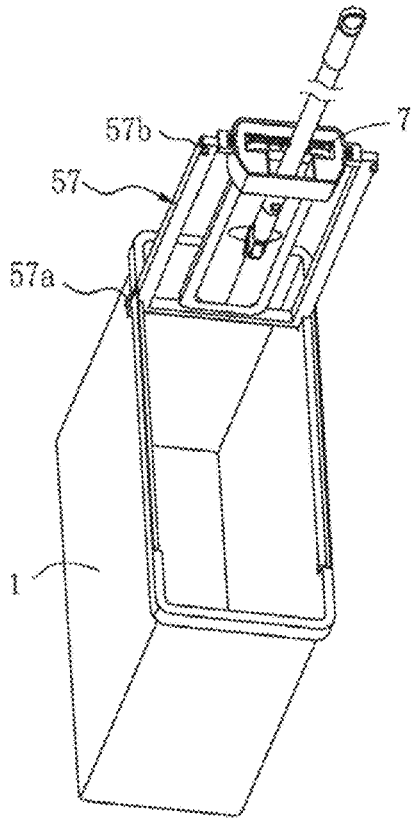
FIG. 32 is a perspective view of a mop bucket according to Embodiment 10 of the present invention (when the squeezing device is disposed within the squeezing water section)

FIG. 31-FIG. 32 show an eleventh embodiment of the mop bucket for cleaning and squeezing a flat mop. The difference between this embodiment and Embodiment 1 of the mop bucket is that, the squeezing water section 5 and the cleaning section 6 are located within a same space of the bucket body 1 of the mop bucket and the squeezing device 7 is switched between the squeezing water section 5 and the cleaning section 6 by the horizontal state and the vertical state of the squeezing device. Specifically, a turnover frame 57 with a head 57*a* and a tail portion 57*b* is disposed on the bucket body 1; the head portion 57*a* is hinged to a top of the bucket body; the squeezing device 7 is rotatably disposed on the tail portion 57*b* of the turnover frame 57; the turnover frame 57 can be positioned and switched between a horizontal state and a vertical state relative to the top of the bucket body 1, so as to switch the squeezing device 7 between the squeezing water section 5 and the cleaning section 6.

In this embodiment, vertical hinge joints are disposed at upper ends of two side surfaces of the bucket body 1; two hinge shafts are correspondingly disposed at the head 57*a* of the turnover frame 57; and the two hinge shafts are disposed within the two hinge joints, respectively. When the turnover frame 57 is placed horizontally, the tail portion 57*b* is snap-jointed with the bucket body 1, a cleaning section is formed within the bucket body 1, and the mop head 4 moves back and forth realize movement in relative to the squeezing device 7 for the purposes of squeezing and cleaning. After the turnover frame 57 is turned over uprightly, the tail portion 57*b* is snap-jointed with the bucket body 1, a squeezing water section is formed within a section of the turnover frame 57 above the bucket body 1, and the mop head 4 moves back and forth to realize movement in relative to the squeezing device 7 for the purposes of squeezing and squeezing.

Embodiment 12 of the Mop Bucket of the Present Invention

Figure 33:
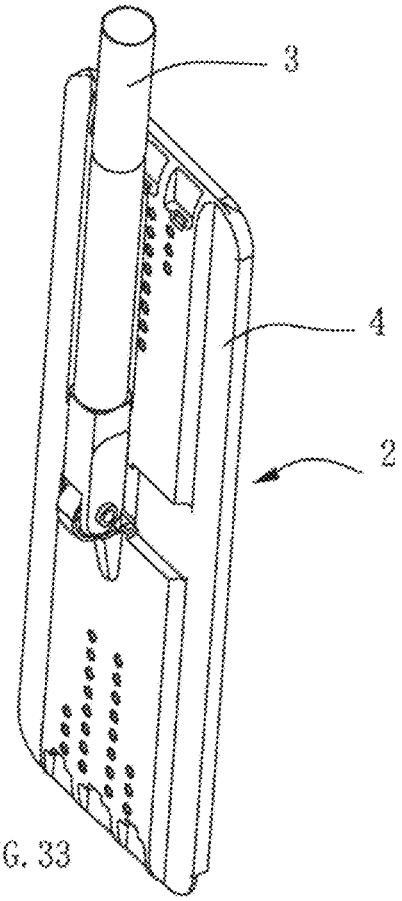
FIG. 33 is a perspective view of a flat mop of a mop bucket according to Embodiment 12 of the present invention.

FIG. 33-FIG. 42 show a twelfth embodiment of the mop bucket for cleaning and squeezing a flat mop. The mop bucket comprises a bucket body 1, and a flat mop 2 used together with the mop bucket comprises a mop rod 3 and a mop head 4 rotatably attached to the mop rod 3, and a wiper is disposed on the mop head 4, as shown in FIG. 33.

The bucket body 1 has a squeezing water section 5 and a cleaning section 6 which are physically separated with each other inside the bucket body 1; a squeezing device is disposed in the squeezing water section 5, and a cleaner 14' for cleaning the wiper is disposed in the cleaning section 6; the cleaner 14' can move up and down relative to the bucket body 1, when the wiper on the mop head 4 moves relative to the cleaner 14', the wiper on the mop head 4 is cleaned for being scrapped between the wiper on the mop head 4 and the cleaner 14'. The independent squeezing water section 5 and the independent cleaning section 6 mean that the bucket body 1 is physically divided into two separated volumes, which are not communicated with each other, one volume defined as the cleaning section 6, and another volume defined as the squeezing water section 5.

The squeezing device can be anyone of the squeezing devices described above. In this embodiment, the squeezing device comprises a squeezer 7' and a first support opposite to the squeezer 7'; the squeezer 7' is used for squeezing the wiper on the mop head 4; the first support is directly disposed on mop bucket; the space between the squeezer 7' and the first support is defined as a squeezing space. Due to the presence of the first support, the mop head 4 can be prevented from warping or skewing during squeezing.

The specific shape and structure of the squeezer 7' can be in various forms. For example, the squeezer 7' is a squeezing roller, a squeezing sheet, a squeezing plate or the like. In addition, the squeezer 7' is directly or indirectly disposed on the bucket body 1 of the mop bucket. In this embodiment, the squeezer 7' is indirectly disposed on the bucket body 1 of the mop bucket. As shown in FIG. 10, the squeezer 7' is disposed on a frame 8', and the frame 8' is then disposed on the mop bucket.

To prevent the mop head 4 from warping or skewing during squeezing, a first support is disposed on the mop bucket. The first support supports and positions the mop head 4. During squeezing, the first support will not always be in contact with the mop head.

The detail structure of the first support can be anyone of the following five embodiments.

Embodiment 1 of the First Support of the Present Invention

Figure 38:
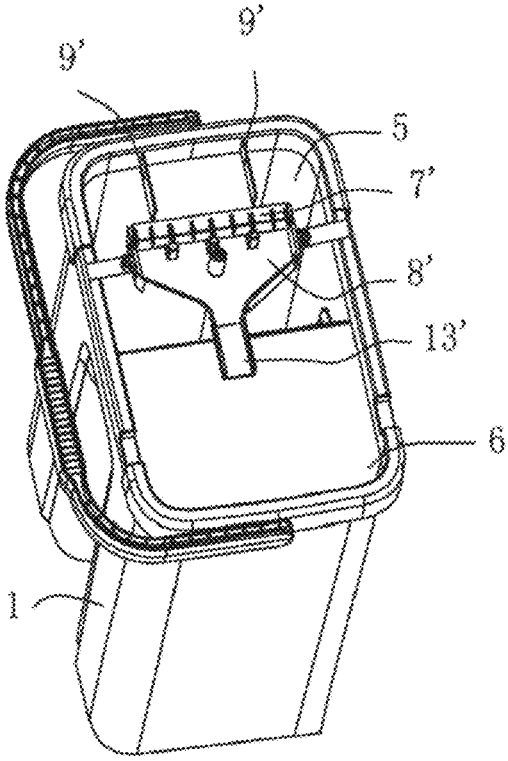
FIG. 38 is a perspective view of a first support according to Embodiment 1 of the present invention.

FIG. 38 shows Embodiment 1 of first support, in this embodiment, the first support is a pair of support ribs 9' longitudinally extending from an end surface of the bucket body 1.

Embodiment 2 of the First Support of the Present Invention

Figure 39:
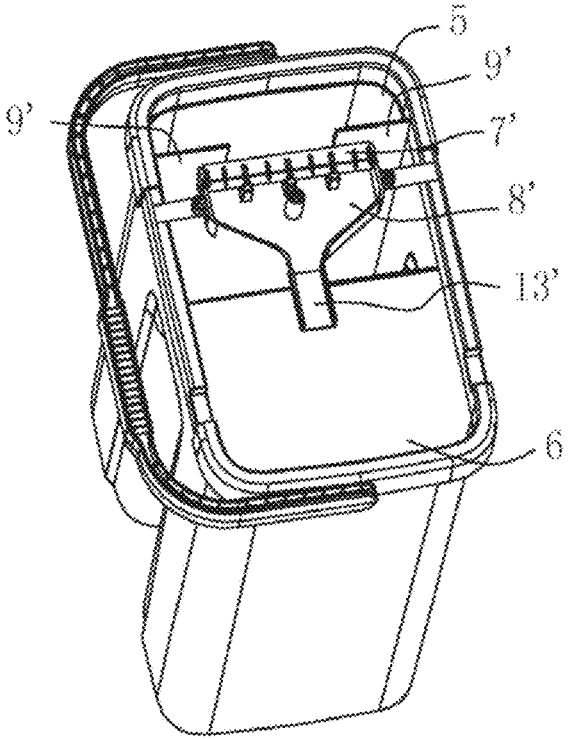
FIG. 39 is a perspective view of a first support according to Embodiment 2 of the present invention.

FIG. 39 shows Embodiment 2 of the first support. The difference between the first support of Embodiment 2 and of Embodiment 1 is, the mounting position of the first support. Specifically, the first support is a pair of support ribs 9' transversely extending from a side surface of the bucket body 1.

Embodiment 3 of the First Support of the Present Invention

Figure 40:
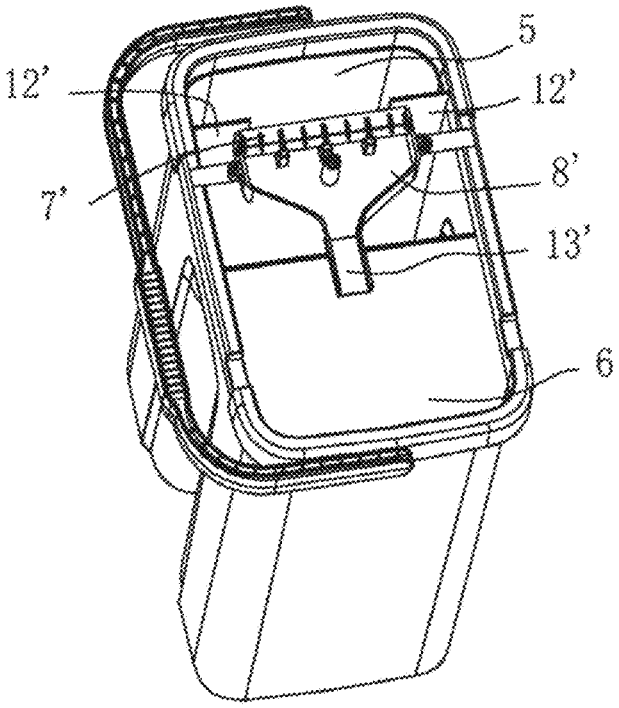
FIG. 40 is a perspective view of a first support according to Embodiment 3 of the present invention.

FIG. 40 shows Embodiment 3 of the first support. The difference between the first support of Embodiment 3 and of Embodiment 1 is that, the structure of the first support is different. Specifically, the first support is a pair of guide plates 12' transversely extending from a side surface of the bucket body 1, and guide slots are disposed on two sides of the mop head. When the mop head 4 is inserted into a squeezing space, the pair of guide plates 12' are inserted into the guide slots so as to support and position the mop head 4.

Embodiment 4 of the First Support of the Present Invention

Figure 41:
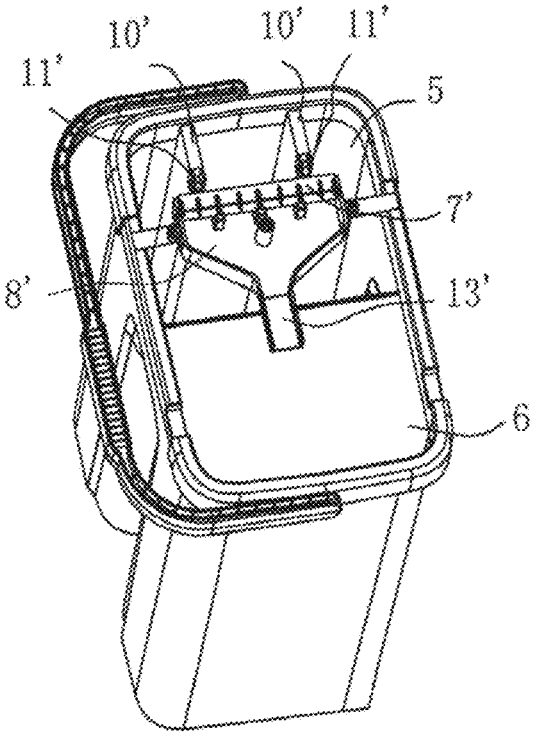
FIG. 41 is a perspective view of a first support according to Embodiment 4 of the present invention.

FIG. 41 shows Embodiment 4 of the first support. The difference between the first support of Embodiment 4 and of Embodiment 1 is that, the structure of the first support is different. Specifically, the first support is a pair of support frames 10' longitudinally extending from an end surface of the bucket body 1, with a roller 11' being disposed at a tail end of each of the support frames 10'.

Embodiment 5 of the First Support of the Present Invention

Figure 42:
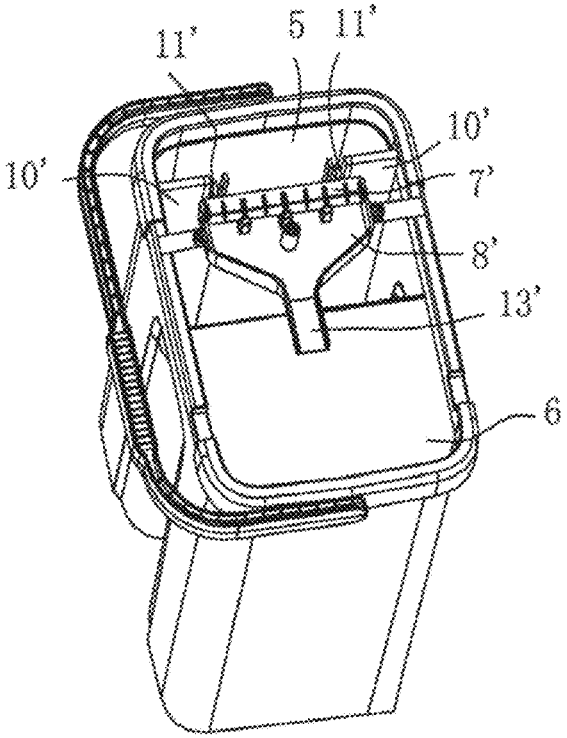
FIG. 42 a perspective view of a first support according to Embodiment 5 of the present invention.

FIG. 42 shows Embodiment 5 of the first support. The difference between the first support of Embodiment 2 and of Embodiment 1 is that, the structure of the first support is different. Specifically, the first support is a pair of support frames 10' transversely extending from a side surface of the bucket body 1, with a roller 11' being disposed on each of the support frames 10'.

In addition, the first support can also be a wall of the mop bucket opposite to the squeezer 7.

In order to prevent the wrung water from retaining in the squeezing water section 5, a water flow device for transferring water in the squeezing water section 5 to the cleaning section 6 is disposed in the squeezing water section 5. The water flow device can be an existing water pumping device which directly pumps water on the bottom of the squeezing water section to the cleaning section. In this embodiment, the water flow device is a water flow passenger 13' communicating the squeezing water section 5 and the cleaning section 6, and the water flow passenger 13' is disposed over the squeezing water section 5 and the cleaning section 6. As shown in FIGS. 10 to 14, specifically, when the squeezer 7 is disposed on the frame 8, the water flow passenger 13' can be directly disposed on the frame 8', that is, the wrung water can be transferred to the cleaning section 6 by the water flow passenger 13', so that the wrung water is prevented from retaining in the squeezing water section 5.

In this embodiment, the cleaner 14' is provided within the bucket body 1 in such a way that the cleaner 14' can be moved up and down. During cleaning, the mop head 4 is switched to the cleaning state, and the cleaner 14' is moved up and down, so that the mop head 4 is moved relative to the cleaner 14 to clean the wiper by the cleaner 14'. Switching the mop head 4 to the cleaning state is generally rotating the mop head 4 to be parallel to or approximately parallel to the mop rod 3. In addition, the structure of the cleaner 14' will not be limited as long as the cleaner can scrape and thus clean the wiper on the mop head.

In this embodiment, the movement of the cleaner 14' is achieved by hand. As shown in FIGS. 2 to 5, by moving the cleaner 14' up and down by hand, the relative movement between the cleaner 14 and the mop head 4 is achieved, and the wiper is cleaned by the cleaner 14'.

The detail structure of the cleaner can be anyone of the following four embodiments.

Embodiment 1 of the Cleaner of the Present Invention

Figure 34:
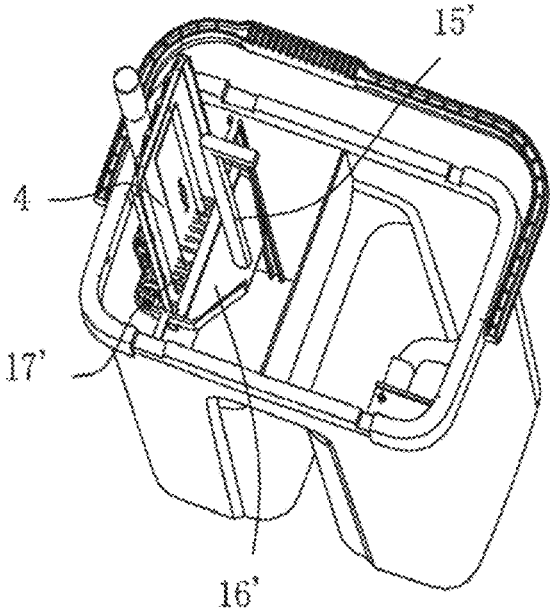
FIG. 34 is a perspective view of a cleaner according to Embodiment 1 of the present invention.

FIG. 34 shows Embodiment 1 of the cleaner, in this embodiment, the cleaner 14' has a cleaning plate 16', and a cleaning component is disposed on a side of the cleaning plate 14'. In this embodiment, the cleaning component is brush bristle 17'. The wiper is cleaned by the cleaning component.

Embodiment 2 of the Cleaner of the Present Invention

Figure 35:
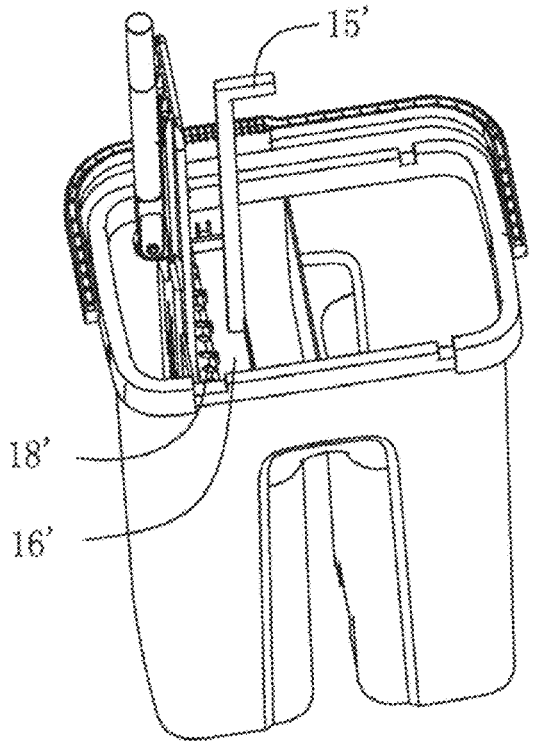
FIG. 35 is a perspective view of a cleaner according to Embodiment 2 of the present invention.

FIG. 35 shows Embodiment 2 of the cleaner. The difference between the cleaner of Embodiment 2 and of Embodiment 1 is that, the cleaning component is different. Specifically, the cleaning component in this embodiment is a scraper 18'.

Embodiment 3 of the Cleaner of the Present Invention

Figure 36:
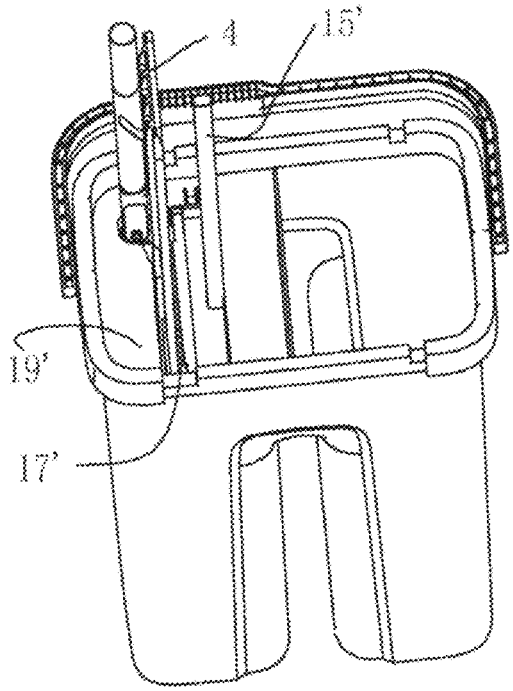
FIG. 36 is a perspective view of a cleaner according to Embodiment 3 of the present invention.

FIG. 36 shows Embodiment 3 of the cleaner. The difference between the cleaner of Embodiment 3 and of Embodiment 1 is that, the structure of the cleaner is different. Specifically, the cleaner 14' has an enclosure frame 19', and a cleaning component is disposed within the enclosure frame 19', wherein the cleaning component is brush bristle 17'.

Embodiment 4 of the Cleaner of the Present Invention

Figure 37:
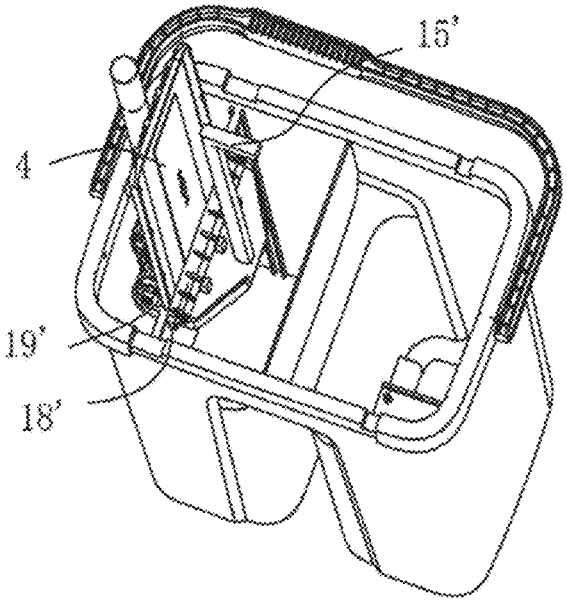
FIG. 37 is a perspective view of a cleaner according to Embodiment 4 of the present invention.

FIG. 37 shows Embodiment 4 of the cleaner. The difference between the cleaner of Embodiment 4 and of Embodiment 1 is the cleaning component. Specifically, the cleaner 14' has an enclosure frame 19', and a cleaning component is disposed within the enclosure frame 19', wherein the cleaning component is a scraper 18'.

The cleaner in this embodiment can be of a cleaner structure described above, and the cleaning component in the cleaner can also be soft rubber. The cleaning plate or the enclosure frame can be lifted and guided by guide rails which can be disposed on the wall of the mop bucket.

Embodiment 13 of the Mop Bucket of the Present Invention

Figure 43:
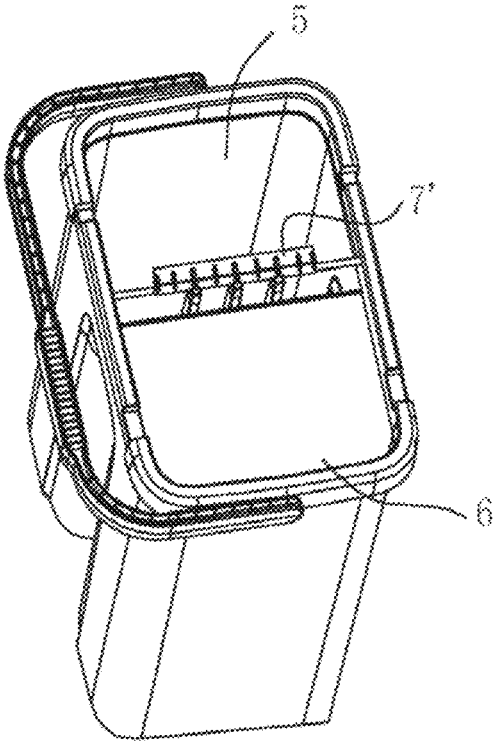
FIG. 43 is a perspective view of a mop bucket according to Embodiment 13 of the present invention.

FIG. 43 shows a thirteenth embodiment of the mop bucket for cleaning and squeezing a flat mop 4. The difference between Embodiment 13 of the mop bucket and Embodiment 12 of the mop bucket is that, the squeezer 7' can be directly disposed on the mop bucket. Specifically, two ends of the squeezer 7' are directly inserted into two side surfaces of the mop bucket so that the squeezer 7' is directly connected to the mop bucket.

Embodiment 14 of the Mop Bucket of the Present Invention

Figure 44:
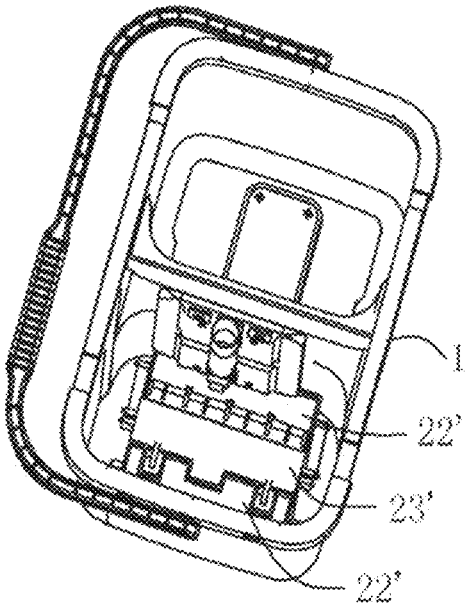
FIG. 44 is a perspective view of a mop bucket according to Embodiment 14 of the present invention.
Figure 45:
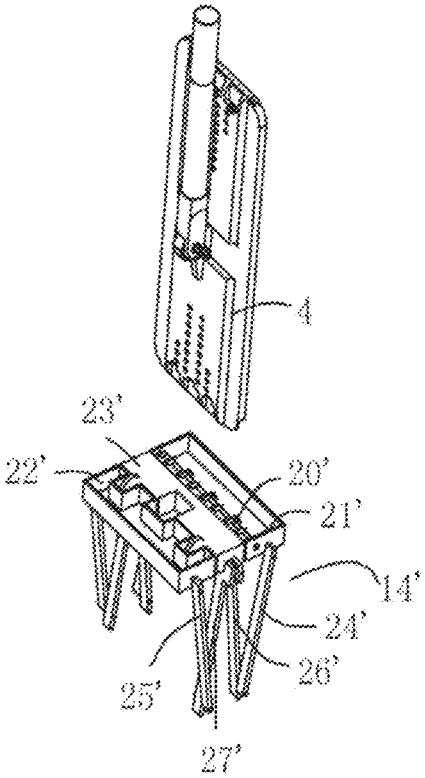
FIG. 45 is a perspective view of a cleaner of the mop bucket according to Embodiment 14 of the present invention.

FIG. 44-FIG. 45 show a fourteenth embodiment of the mop bucket for cleaning and squeezing a flat mop. The differences between this embodiment and Embodiment 12 of the mop bucket is that, the structure of the cleaner is different and the manner for moving the cleaner 14' up and down is different (that is, the cleaner 14' is driven to move up and down by the mop head 4). Specifically, the cleaner 14' comprises a first frame 21', a second frame 22' and a third frame 23' between the first frame 21' and the second frame 22', which are separate from each other; a cleaning component 20' is disposed on the first frame 21' (or the second frame 22'). In this embodiment, the cleaning component may be brush bristle, soft rubber, a scraper or the like. A first rod 24' is hinged at two ends of the first frame 21', a second rod 25' is hinged at two ends of the second frame 22', and a third rod 26' close to the first frame 21' and a fourth rod 27' close to the second frame 22' are hinged at two ends of the third frame 23'; the first rod 24' and the third rod 26' are hinged at their lower ends, and the second rod 25' and the fourth rod 27' are hinged at their lower ends; during cleaning, a force is applied after the mop head 4 is aligned with the third frame 23', so that the first frame 21' and the second frame 22' can move upward; and, when the mop head 4 is pulled back, the first frame 21' and the second frame 22' are moved down automatically, so that the wiper is cleaned by the cleaning component 20'.

In practical applications, the mop head 4 is pressed down to drive the cleaner 14' to ascend; and, when the mop head 4 is pulled back, the cleaner 14' is driven to descend, so that the relative movement between the cleaner and the mop head 4 is realized.

Embodiment 15 of the Mop Bucket of the Present Invention

Figure 46:
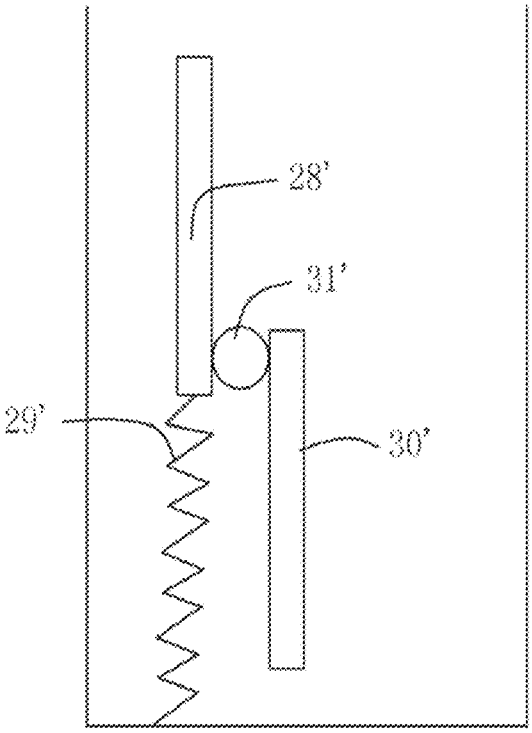
FIG. 46 is a schematic diagram of the coordination of a cleaner with a gear-rack of a mechanism according to Embodiment 15 of the present invention.

FIG. 46 shows a fifteenth embodiment of the mop bucket for cleaning and squeezing a flat mop. The difference between this embodiment and Embodiment 14 of the mop bucket is that, the cleaner is connected to a gear-rack mechanism which is driven by the mop head to move the cleaner up and down. Specifically, the gear-rack mechanism comprises a vertical driving rack 28' which is connected to the bottom of the mop bucket via a spring 29' and a vertical driven gear 30'; a gear 31' positioned within the mop bucket is disposed between the driven rack 30' and the driving rack 28'; the gear 31' is engaged with the driving rack 28' and the driven rack 30', respectively; a cleaning component is disposed on a surface of the driven rack 30' having teeth formed thereon; the mop head 4 is aligned with the driving rack 28' after it is pressed down, so that the driving rack 28' is pressed down while the driven rack 30' is moved up, and the wiper is cleaned by the cleaning component; when the mop head 4 is pulled back, the driving rack 28' and the driven rack 30' return to the original position, and the wiper is cleaned again by the cleaning component.

Embodiment 16 of the Mop Bucket of the Present Invention

Figure 47:
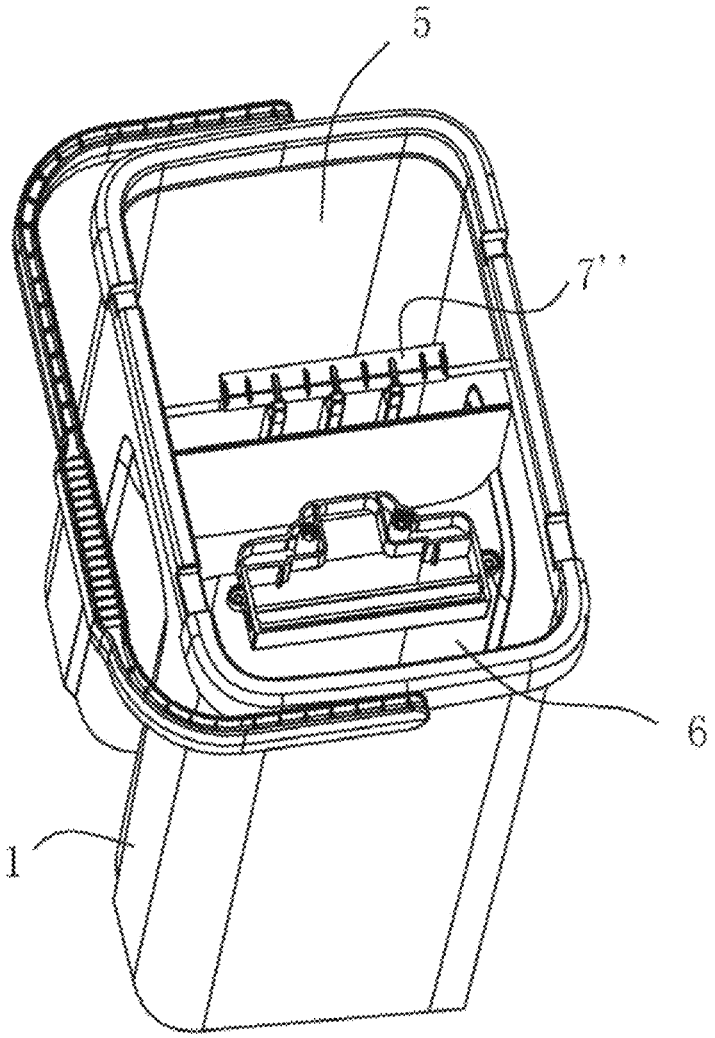
FIG. 47 is a perspective view of a mop bucket to which a first squeezing device is applied according to Embodiment 16 of the present invention.

FIG. 47 shows a sixteenth preferred embodiment of the mop bucket of the present invention. The mop bucket comprises a bucket body 1, a flat mop 2 used together with the mop bucket comprises a mop rod 3 and a mop head 4 rotatably attached to the mop rod 3, and a wiper is disposed on the mop head 4, as shown in FIG. 33.

The bucket body 1 has an independent cleaning section 6 and an independent squeezing water section 5 which are physically separated with each other inside the bucket body 1. A squeezing device 7 is disposed in the squeezing water section 5, and a cleaning device for cleaning the wiper is disposed in the cleaning section 6. The independent squeezing water section 5 and the independent cleaning section 6 mean that the bucket body 1 is physically divided into two separated volumes, which are not communicated with each other, one volume defined as the cleaning section 6, and another volume defined as the squeezing water section 5.

The squeezing device comprises a squeezer 7" for squeezing the wiper on the mop head and a first support opposite to the squeezer 7"; the squeezer 7" is directly or indirectly disposed on the bucket body 1, and the first support is directly disposed on the bucket body 1; the space between the squeezer 7" and the first support is defined as a squeezing space; during squeezing, the mop head 4 is switched to the squeezing state, when the mop head 4 is inserted into the squeezing space, the wiper on the mop head 4 can move relatively to the squeezer 7" and be squeezed by the squeezer 7". Switching the mop head 4 to the squeezing state generally is rotating the mop head 4 to be parallel to or approximately parallel to the mop rod 3, so that the mop head 4 can be smoothly moved up and down in the squeezing space for squeezing. The specific shape and structure of the squeezer 7" can be in various forms. For example, the squeezer 4 is a squeezing roller, a squeezing sheet, a squeezing plate or the like.

The squeezer 7" can be directly disposed on the mop bucket. For example, FIG. 47 shows a first kind of squeezing device, where two ends of the squeezer 7" are directly inserted two side surfaces of the bucket body 1 and the squeezer 7" is directly connected to the bucket body 1. The squeezer 7" can also be indirectly disposed on the bucket body 1. For example, FIG. 48-FIG. 52 show a second kind to sixth kind of squeezing devices, where the squeezer 7" is disposed on a frame 8" and the frame 8" is then disposed on the bucket body 1.

Figure 48:
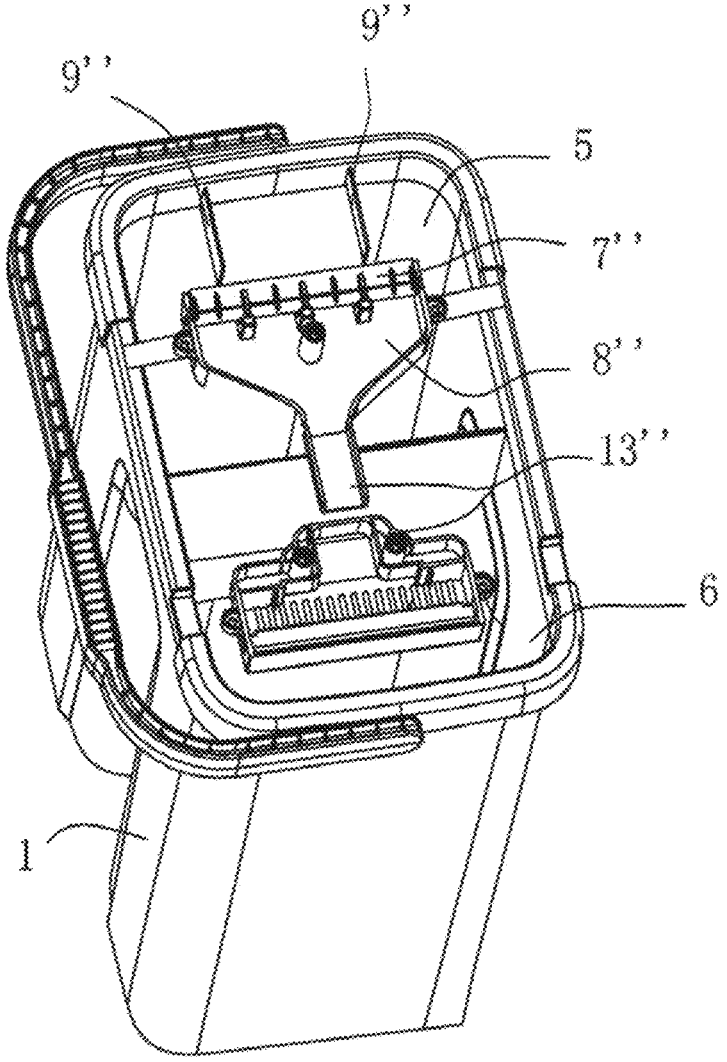
FIG. 48 is a perspective view of the mop bucket to which a second squeezing device is applied according to Embodiment 16 of the present invention.
Figure 49:
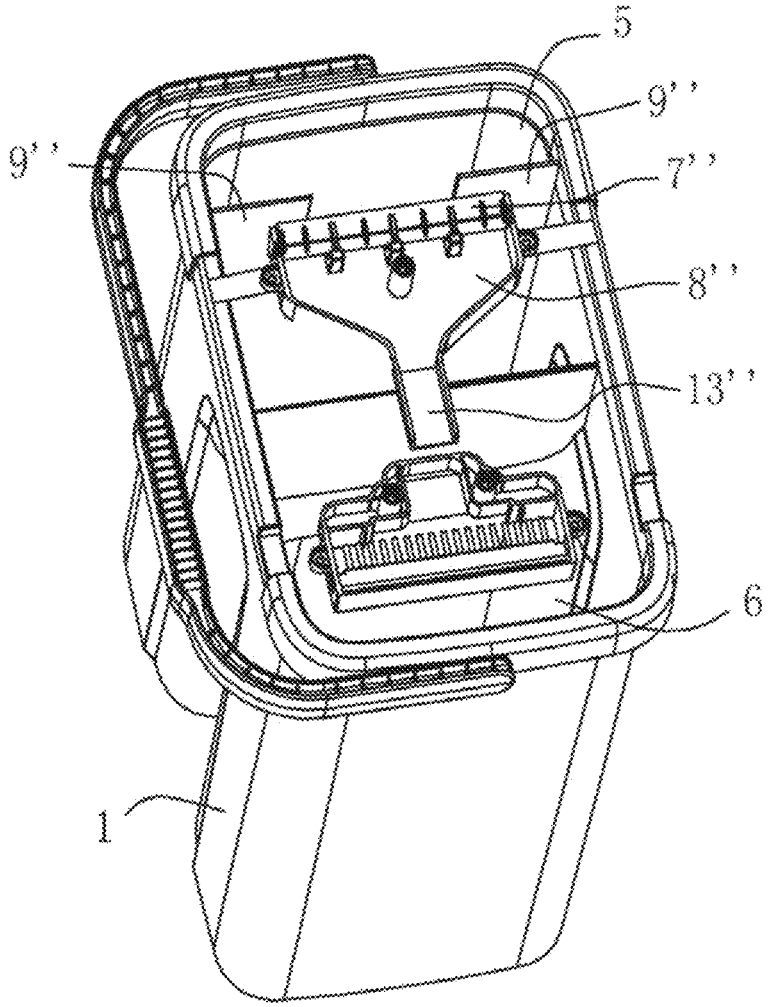
FIG. 49 is a perspective view of the mop bucket to which a third squeezing device is applied according to Embodiment 16 of the present invention.
Figure 51:
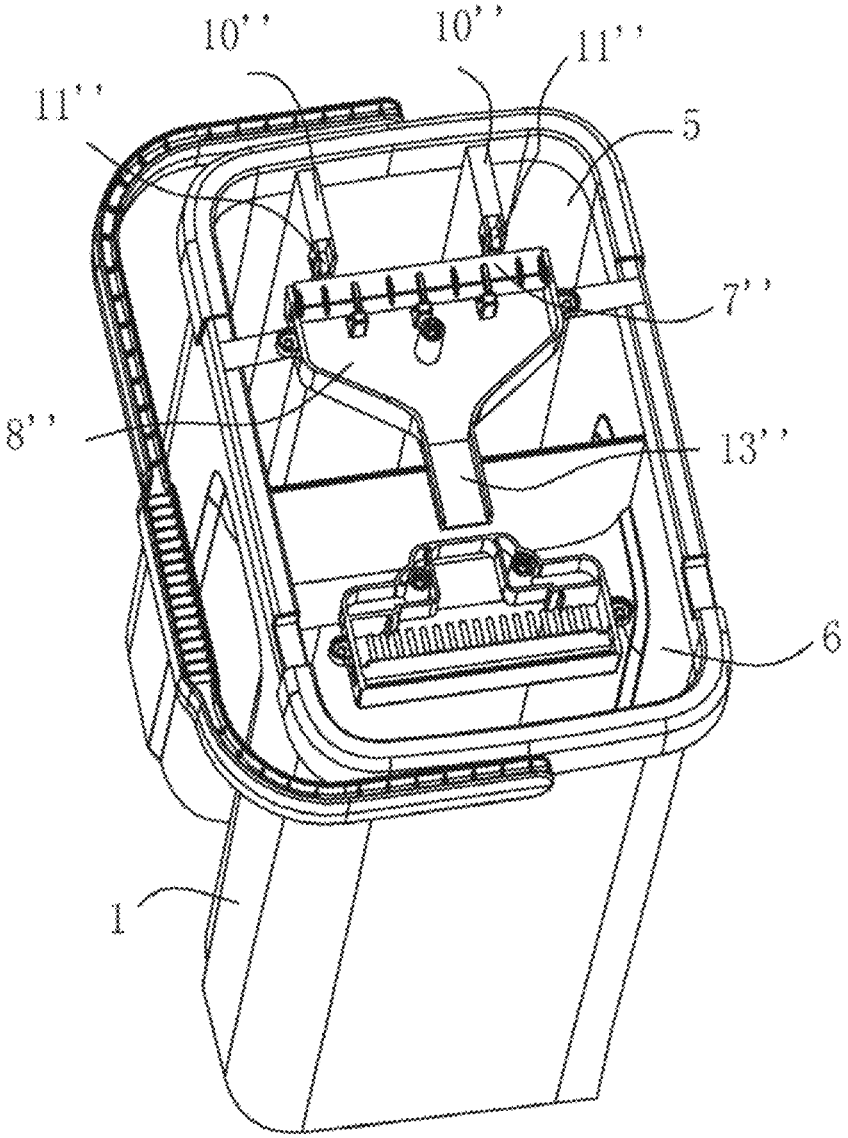
FIG. 51 is a perspective view of the mop bucket to which a fifth squeezing device is applied according to Embodiment 16 of the present invention.
Figure 52:
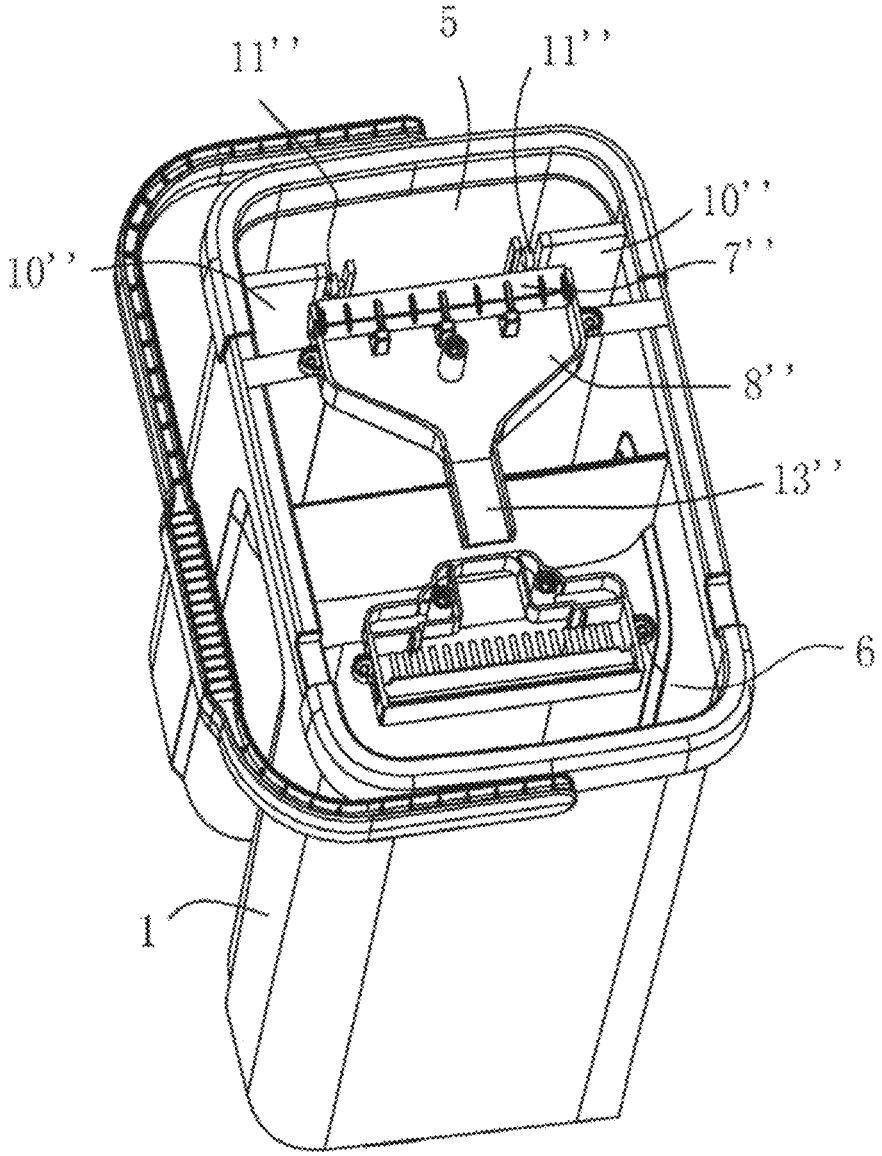
FIG. 52 is a perspective view of the mop bucket to which a sixth squeezing device is applied according to Embodiment 16 of the present invention.

The specific structure of the first support will not be limited as long as the first support can support and position the mop head 4 inserted into the squeezing layer. For example, FIG. 48 shows a second kind of squeezing device, where the first support is a pair of support ribs 9" longitudinally extending from an end surface of the bucket body 1; FIG. 49 shows a third kind of squeezing device, where the first support is a pair of support ribs 9" transversely extending from a side surface of the bucket body 1; FIG. 51 shows a fifth kind of squeezing device, where the first support is a pair of support frames 10" longitudinally extending from an end surface of the bucket body 1, with a roller 11" being disposed at a tail end of each of the support frames 10"; FIG. 52 shows a sixth kind of squeezing device, where the first support is a pair of support frames 10" transversely extending from a side surface of the bucket body 1, with a roller 11" being disposed at a tail end of each of the support frames 10"; or, the first support is the wall of the mop bucket opposite to the squeezer 7". When the mop head 4 is inserted into the squeezing space for squeezing, the first support functions to support and position the mop head 4 so as to prevent the mop head 4 from warping or skewing during squeezing. It is to be noted that, when the first support mechanism is used, the first support will not always be in contact with the mop head during squeezing.

Figure 50:
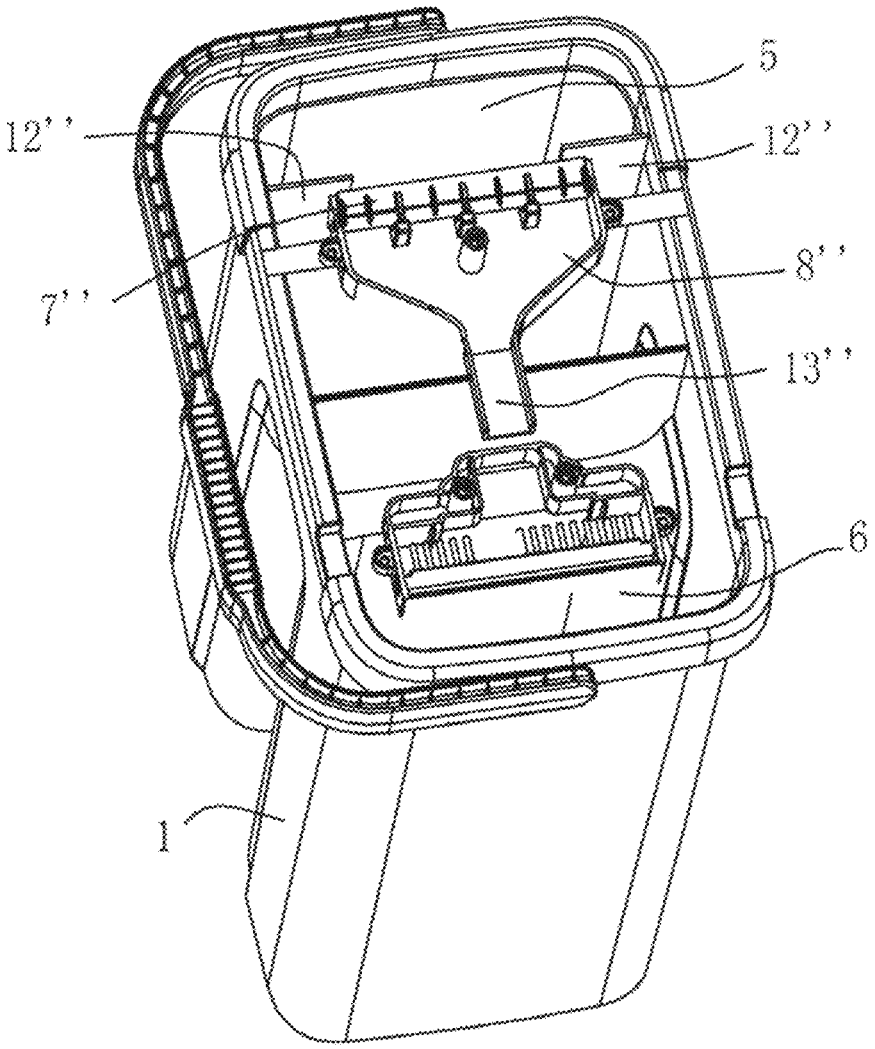
FIG. 50 is a perspective view of the mop bucket to which a forth squeezing device is applied according to Embodiment 16 of the present invention.

Or, FIG. 50 shows a fourth kind of squeezing device, where the first support is a pair of guide plates 12" transversely extending from a side surface of the bucket body 1, and guide slots are formed on two sides of the flow mop head. When the mop head 4 is inserted into the squeezing space, the pair of guide plates 12" are inserted into the guide slots so as to support and position the mop head 4.

In this embodiment, in order to prevent the wrung water from retaining in the squeezing water section 5, a water flow device for transferring water in the squeezing water section 5 to the cleaning section 6 is disposed within the squeezing water section 5. The water flow device can be an existing water pumping device which directly pumps water on the bottom of the squeezing water section to the cleaning section. In this embodiment, the water flow device is a water flow passenger 13" communicating the squeezing water section 5 and the cleaning section 6, and the water flow passenger 13" is disposed over the squeezing water section 5 and the cleaning section 6. As shown in FIGS. 48-FIG. 52, when the squeezer 7" is disposed on the frame 8", the water flow passenger 13" can be directly disposed on the frame 8"; and, when the squeezer 7" is directly disposed on the mop bucket, the water flow passenger 13" can be disposed in other ways.

The cleaning device comprises a cleaner 14" for squeezing and scraping the wiper on the mop head 4 and a second support opposite to the cleaner 14"; the cleaner 14" is directly or indirectly disposed on the bucket body 1, and the second support is directly disposed on the bucket body 1; the space between the cleaner 14" and the second support is defined as a cleaning space; and, During cleaning, the mop head 4 is switched to the cleaning state, when the mop head 4 is inserted into the cleaning space, the wiper on the mop head 4 can move relatively to the cleaner 14" and be squeezed by the cleaner 14".

Switching the mop head 4 to the cleaning state generally is rotating the mop head 4 to be parallel to or approximately parallel to the mop rod 3, so that the mop head 4 can be smoothly moved up and down in the cleaning interlayer for squeezing. The specific shape and structure of the cleaner 14" can be in various forms. For example, the cleaner 14" is a cleaning scraper, a cleaning brush, cleaning teeth or soft cleaning rubber.

The cleaner 14" can be directly disposed on the bucket body 1. For example, the cleaner is a cleaning scraper. Two ends of the cleaner are directly inserted into two side surfaces of the mop bucket, and the cleaner is directly connected to the mop bucket. Or, when the cleaner is a cleaning brush, cleaning teeth, soft cleaning rubber or in other structures, the cleaning brush, the cleaning teeth, the soft cleaning rubber and the like can be directly disposed on the wall of the mop bucket.

The cleaner 14" can also be indirectly disposed on the bucket body 1. For example, FIG. 53-FIG. 58 show a first kind to sixth kind of cleaning devices, where the cleaner 14" is disposed on a cleaning frame 15" and the cleaning frame 15" is then disposed on the bucket body 1.

Figure 53:
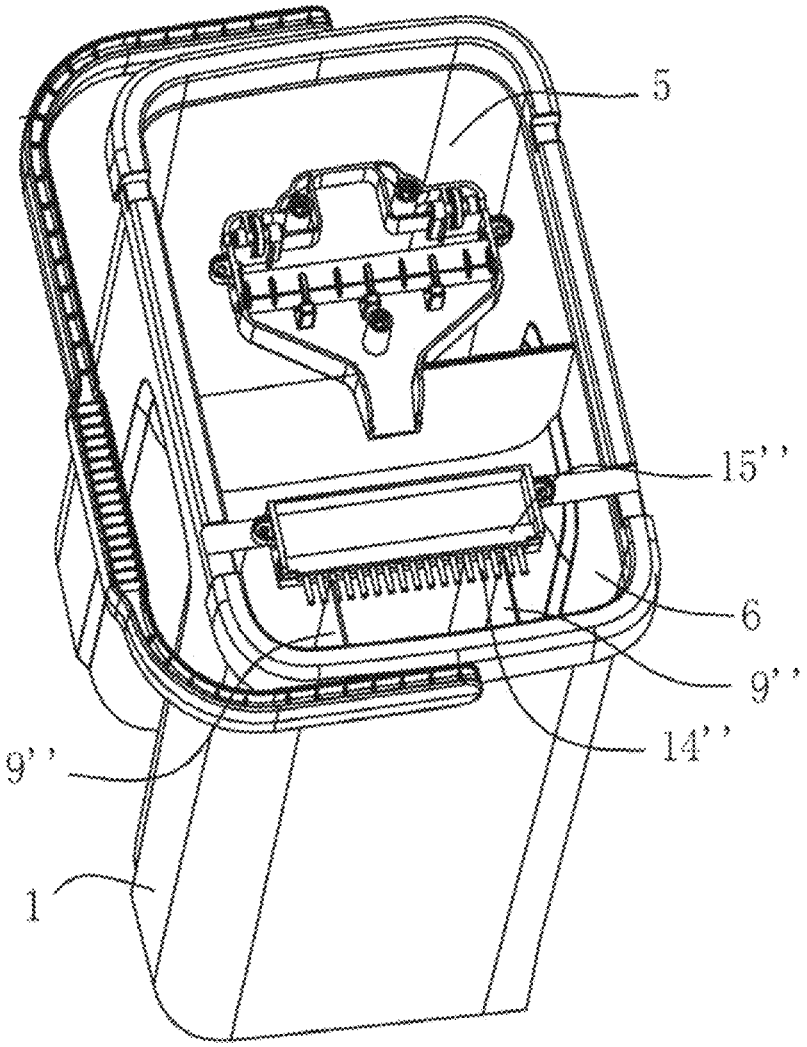
FIG. 53 is a perspective view of the mop bucket to which a first cleaning device is applied according to Embodiment 16 of the present invention.
Figure 54:
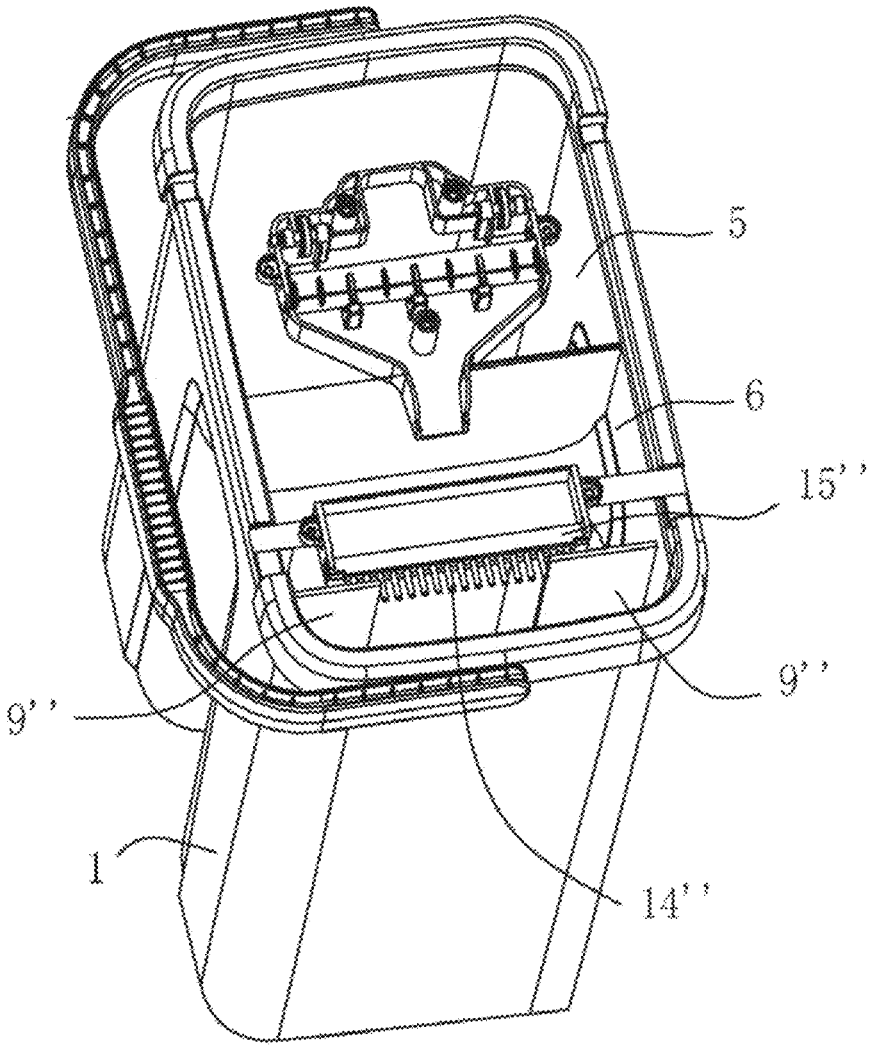
FIG. 54 is a perspective view of the mop bucket to which a second cleaning device is applied according to Embodiment 16 of the present invention.
Figure 56:
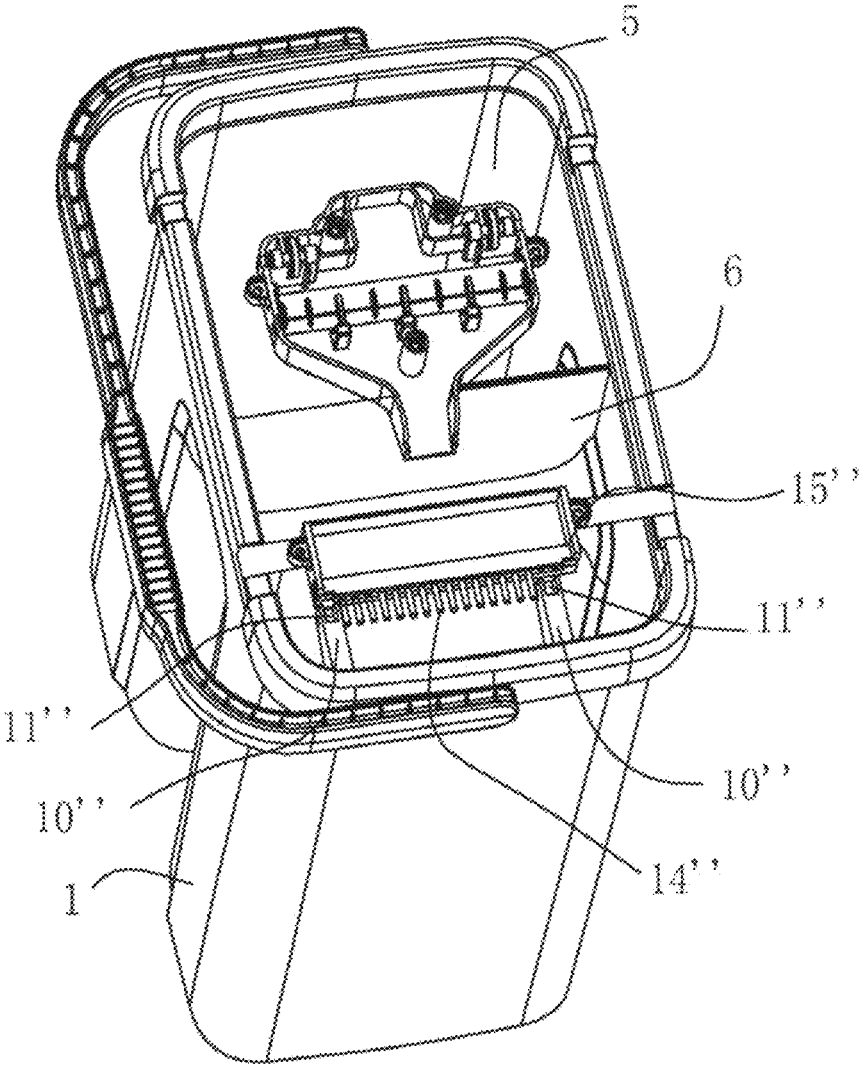
FIG. 56 is a perspective view of the mop bucket to which a forth cleaning device is applied according to Embodiment 16 of the present invention.
Figure 57:
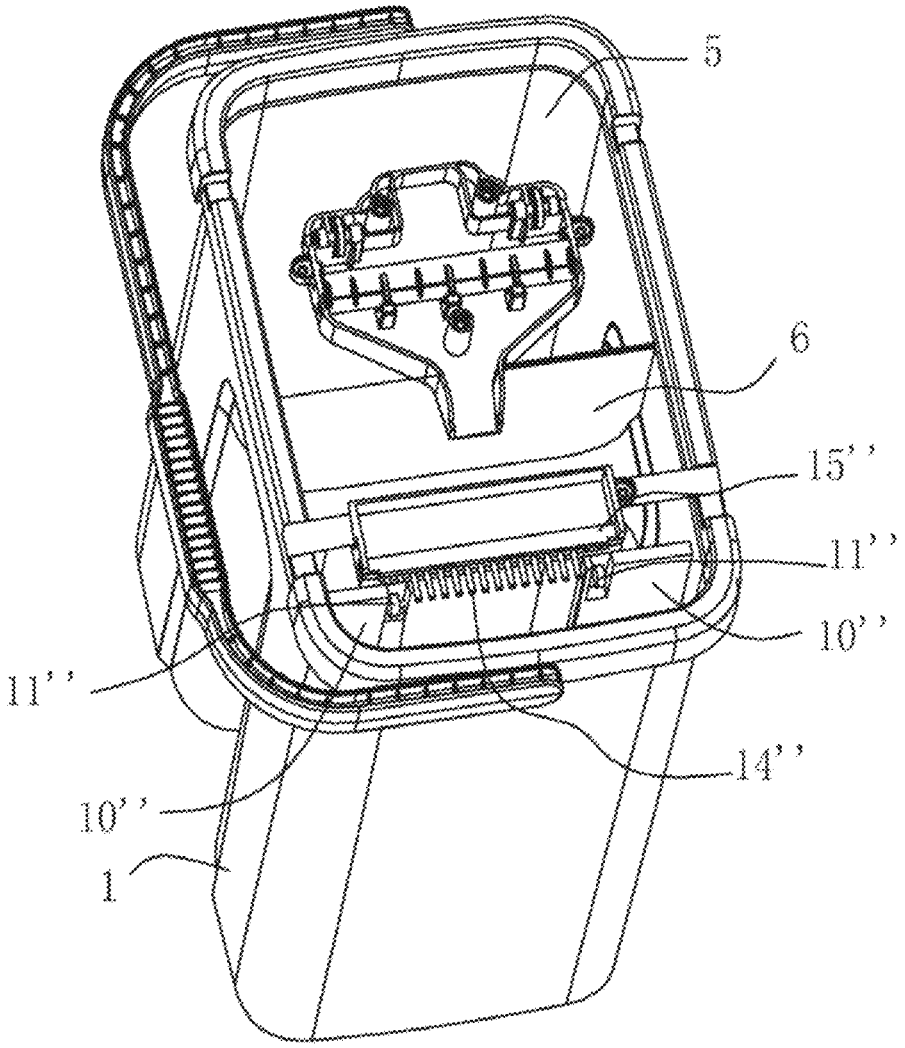
FIG. 57 is a perspective view of the mop bucket to which a fifth cleaning device is applied according to Embodiment 16 of the present invention.
Figure 58:
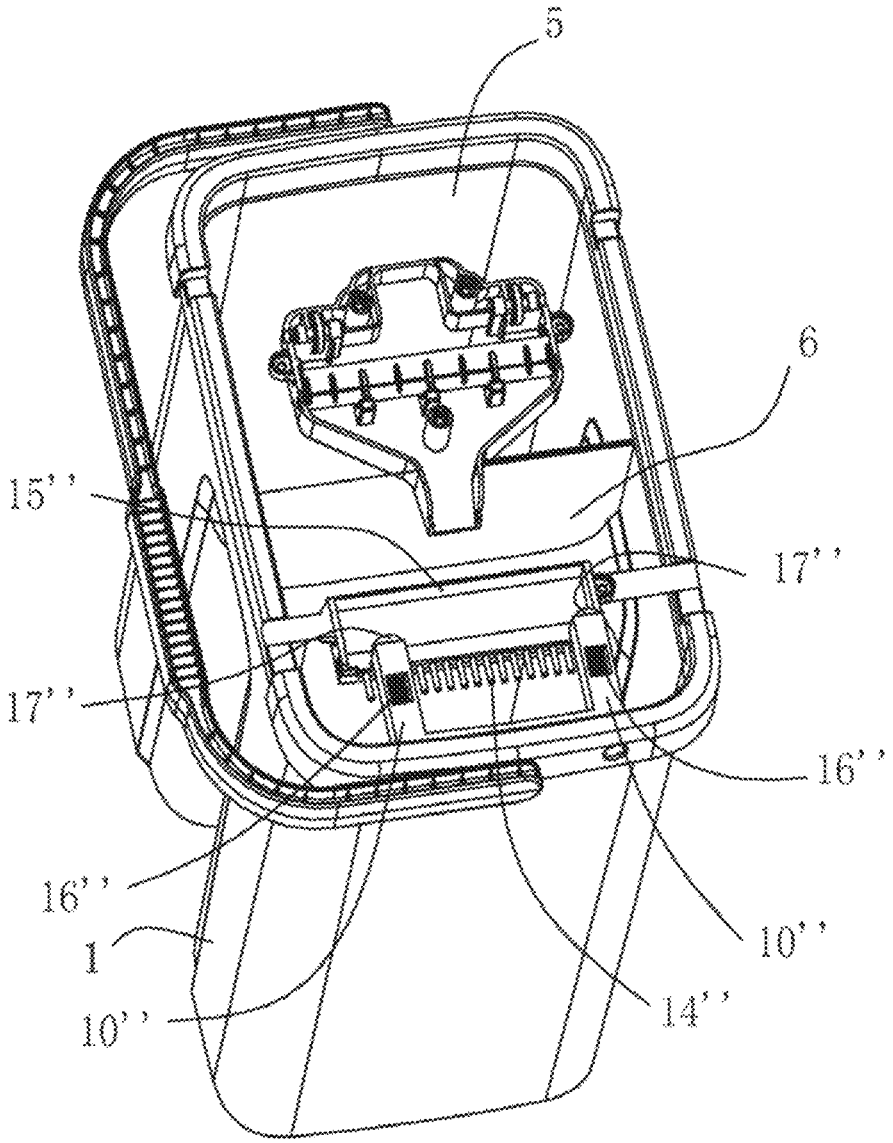
FIG. 58 is a perspective view of the mop bucket to which a sixth cleaning device is applied according to Embodiment 16 of the present invention.

The specific structure of the second support will not be limited as long as the second support can support and position the mop head 4 inserted into the squeezing layer. For example, FIG. 53 shows a first kind of cleaning device, where the second support is a pair of support ribs 9" longitudinally extending from an end surface of the bucket body 1; FIG. 54 shows a second kind of cleaning device, where the second support is a pair of support ribs 9" transversely extending from a side surface of the bucket body 1; FIG. 56 shows a fourth kind of cleaning device, where the second support is a pair of support frames 10" longitudinally extending from an end surface of the bucket body 1, with a roller 11" being disposed at a tail end of each of the support frames 10"; FIG. 57 shows a fifth kind of cleaning device, where the second support is a pair of support frames 10" transversely extending from a side surface of the bucket body 1, with a roller 11" being disposed on each of the support frames 10"; FIG. 58 shows a sixth kind of cleaning device, where the second support is a pair of support frames 10" longitudinally extending from an end surface of the bucket body, with a pair of springs 16" and a pair of elastic blocks 17" being disposed in each of the support frames 10", the springs 16" acting on the elastic blocks 17" to allow portions of the elastic blocks 17" to rebound from the tail end of the support frames 10"; or, the second support is the wall of the mop bucket opposite to the cleaner 14". When the mop head 4 is inserted into the cleaning interlayer for cleaning, the second support functions to support and position the mop head 4 so as to prevent the mop head 4 from warping or skewing during cleaning. It is to be noted that, when the second support mechanism is used, the second support will not always be in contact with the mop head 4 during cleaning.

Figure 55:
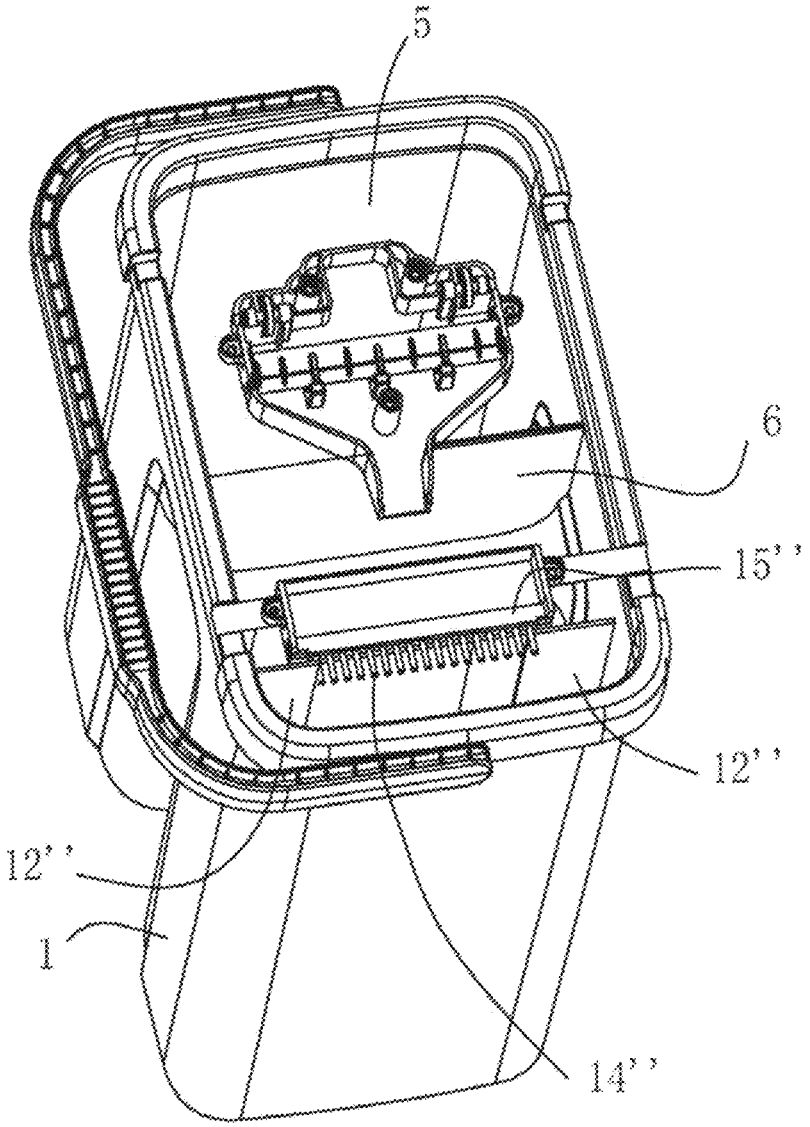
FIG. 55 is a perspective view of the mop bucket to which a third cleaning device is applied according to Embodiment 16 of the present invention.

Or, FIG. 55 shows a third kind of cleaning device, where the second support is a pair of guide plates 12" transversely extending from a side surface of the bucket body 1, and guide slots are formed on two sides of the flow mop head 4. When the mop head 4 is inserted into the cleaning interlayer, the pair of guide plates 12" are inserted into the guide slots so as to support and position the mop head 4.

The invention claimed is:

1. A cleaning tool, comprising: a flat mop, a mop bucket, and a squeezing device, wherein the flat mop comprises a mop rod, a mop head rotatably attached to the mop rod, and a wiper disposed on the mop head;

the mop bucket has a squeezing water section, and the squeezing device is located above the squeezing water section;

during squeezing, the mop head is rotated into a squeezing state so as to squeeze water, the mop rod is pressed down, the flat mop is inserted into the squeezing device, the mop head is moved into the squeezing water section, the flat mop is moved as a whole up and down, and the mop head is moved up and down in the squeezing device so as to squeeze out the water from the wiper; and a water passage is disposed above the squeezing water section for transferring squeezed water out of the squeezing water section so as to avoid or relieve the mop head from absorbing the squeezed water during a press-down squeezing operation.

2. The cleaning tool according to claim 1, wherein the squeezing device comprises a frame and a squeezer;

the frame has a squeezing port for receiving the mop head; and the squeezer is disposed adjacent to the squeezing port, so that the squeezer can press the wiper on the mop head to scrape the wiper.

3. The cleaning tool according to claim 2, wherein the water passage is located within the frame.

4. The cleaning tool according to claim 3, wherein the water passage is located on the outside of the squeezer so that water squeezed out by the squeezer flows away from the wiper along the squeezer and flowing into the water passage.

5. The cleaning tool according to claim 2, wherein the squeezer is a squeezing strip, a squeezing sheet, or a rotatable squeezing water roller.

6. The cleaning tool according to claim 2, wherein the mop rod is rotatably attached to a back surface of the mop head, the squeezing port comprises a first opening for being penetrated by the mop head and a second opening for being penetrated by the mop rod.

7. The cleaning tool according to claim 6, wherein the mop head is rotated parallel to the mop rod so as to achieve the squeezing state.

8. The cleaning tool according to claim 7, wherein the mop head is rotated into a direction where a length of the mop head is along with a length of the mop rod.

9. The cleaning tool according to claim 7, wherein during squeezing, the flat mop is moved down until the mop head touching bottom of the mop bucket, a length of the mop head is matched with a height from the bottom of the mop bucket touching the mop head to the squeezer, so that when the flat mop is inserted into the squeezing port to squeeze water out of the wiper, the wiper will be fully squeezed.

10. The cleaning tool according to claim 9, wherein during squeezing, the wiper moving in the squeezing water section absorbs remaining water, and is squeezed up after multiple squeezing operations.

11. The cleaning tool according to claim 2, wherein the squeezing port is provided with wheels therein corresponding to the squeezer, and when the flat mop is inserted into the squeezing port, the mop head relies on the wheel.

12. The cleaning tool according to claim 1, wherein a buffer for buffering the mop head pressed down is disposed within the squeezing water section, and the mop head pressed down for squeezing contacts the buffer.

13. The cleaning tool according to claim 1, wherein a raised step protruding upwardly from bottom of the squeezing water section is provided, and during squeezing, the flat mop corresponds to the raised step, and the mop head moves down until the raised step.

14. The cleaning tool according to claim 1, wherein the mop bucket has a cleaning section for cleaning the wiper on the mop head; and the cleaning section and the squeezing water section are physically independent and separated with each other so as to prevent water in the cleaning section from flowing into the squeezing water section.

15. The cleaning tool according to claim 14, wherein the cleaning section and the squeezing water section are arranged side by side.

16. The cleaning tool according to claim 14, wherein squeezed water is exhausted into the cleaning section so as to maintain a level of water in the cleaning section.

17. The cleaning tool according to claim 14, wherein a squeezing device is located above the cleaning section; and during cleaning, the mop head is rotated into a cleaning state so as to clean the wiper, the mop rod is pressed down, the flat mop is inserted into the squeezing device, the mop head is moved into the cleaning section, the flat mop is moved as a whole up and down, and the mop head is moved up and down in the squeezing device so as to squeeze and clean the wiper.

18. The cleaning tool according to claim 14, wherein during squeezing, the flat mop is moved down until the mop head touching the bottom of the mop bucket, the length of the mop head is matched with the height from the bottom of the mop bucket touching the mop head to the squeezer, so that when the flat mop is inserted into the squeezing port to squeeze for cleaning the wiper or squeeze water out of the wiper, the wiper will be fully cleaned or squeezed.

* * * * *